US012422163B2

(12) United States Patent
Liu et al.

(10) Patent No.: US 12,422,163 B2
(45) Date of Patent: Sep. 23, 2025

(54) AIR CONDITIONER, CONTROL METHOD FOR AIR CONDITIONER, AND COMPUTER-READABLE STORAGE MEDIUM

(71) Applicants: GD MIDEA AIR-CONDITIONING EQUIPMENT CO., LTD., Guangdong (CN); MIDEA GROUP CO., LTD., Guangdong (CN)

(72) Inventors: Qiwei Liu, Guangdong (CN); Ansheng Ji, Guangdong (CN); Peng Xie, Guangdong (CN); Jian He, Guangdong (CN); Fuxing Zhai, Guangdong (CN); Hui Zheng, Guangdong (CN); Shaosheng Guo, Guangdong (CN); Zhengqing Yi, Guangdong (CN); Jie He, Guangdong (CN)

(73) Assignees: GD MIDEA AIR-CONDITIONING EQUIPMENT CO., LTD., Guangdong (CN); MIDEA GROUP CO., LTD., Shunde Foshan (CN)

( * ) Notice: Subject to any disclaimer, the term of this patent is extended or adjusted under 35 U.S.C. 154(b) by 605 days.

(21) Appl. No.: 17/863,541

(22) Filed: Jul. 13, 2022

(65) Prior Publication Data

US 2022/0341622 A1 Oct. 27, 2022

Related U.S. Application Data

(63) Continuation of application No. PCT/CN2020/128956, filed on Nov. 16, 2020.

(30) Foreign Application Priority Data

Jan. 19, 2020 (CN) ..... 202010061302.5
Jan. 19, 2020 (CN) ..... 202020121594.2

(51) Int. Cl.
*F24F 13/08* (2006.01)
*F24F 1/0011* (2019.01)
(Continued)

(52) U.S. Cl.
CPC ..... *F24F 13/082* (2013.01); *F24F 1/0011* (2013.01); *F24F 1/0033* (2013.01);
(Continued)

(58) Field of Classification Search
CPC ..... F24F 11/082; F24F 11/79; F24F 13/12; F24F 13/20; F24F 1/0011; F24F 1/0088; F24F 2013/205
(Continued)

(56) References Cited

U.S. PATENT DOCUMENTS 11,002,451 B2 * 5/2021 Kim ..... F24F 1/0047
11,067,298 B2 * 7/2021 Kim ..... F24F 11/74
2019/0056120 A1 2/2019 Cho et al.

FOREIGN PATENT DOCUMENTS

CN 105201908 A 12/2015
CN 105387595 A 3/2016
(Continued)

OTHER PUBLICATIONS

Supplementary European Search Report dated Jun. 20, 2023 received in European Patent Application No. EP 20914484.9.
(Continued)

*Primary Examiner* — Avinash A Savani
*Assistant Examiner* — Dana K Tighe
(74) *Attorney, Agent, or Firm* — Scully, Scott, Murphy & Presser, P.C.

(57) ABSTRACT

An air conditioner, a control method for the air conditioner and a computer-readable storage medium are provided. The air conditioner has a shell provided with an opening portion, a first air deflector connected to the shell, an air outlet
(Continued)

defined by the first air deflector and the opening portion, and an air-scattering assembly having an air-scattering component. The air-scattering component allows an airflow to pass through and diffuses the passing airflow. The air-scattering assembly is movable relative to the shell for opening and closing the air outlet. When the air conditioner is closed, the air-scattering assembly and the shell form the exterior of the air conditioner. Meanwhile, various forms of windless air discharges can be provided by the air-scattering assembly.

26 Claims, 17 Drawing Sheets

(51) Int. Cl.
*F24F 1/0033* (2019.01)
*F24F 11/79* (2018.01)
*F24F 13/12* (2006.01)
*F24F 13/20* (2006.01)

(52) U.S. Cl.
CPC ..... *F24F 11/79* (2018.01); *F24F 13/12* (2013.01); *F24F 13/20* (2013.01); *F24F 2013/205* (2013.01)

(58) Field of Classification Search
USPC ..... 454/89
See application file for complete search history.

(56) References Cited

FOREIGN PATENT DOCUMENTS

| | | | | | |
|---|---|---|---|---|---|
| CN | 107631457 | A | | 1/2018 | |
| CN | 107726586 | A | | 2/2018 | |
| CN | 107940720 | A | | 4/2018 | |
| CN | 207317221 | U | * | 5/2018 | ..... F24F 13/14 |
| CN | 108489043 | A | | 9/2018 | |
| CN | 108954770 | A | | 12/2018 | |
| CN | 110057072 | A | | 7/2019 | |
| CN | 110186114 | A | | 8/2019 | |
| CN | 110319563 | A | | 10/2019 | |
| CN | 110319564 | A | | 10/2019 | |
| CN | 110319566 | A | | 10/2019 | |
| CN | 110319567 | A | | 10/2019 | |
| CN | 110319568 | A | | 10/2019 | |
| CN | 110319569 | A | | 10/2019 | |
| CN | 110440432 | A | | 11/2019 | |
| CN | 110701683 | A | | 1/2020 | |
| CN | 110701770 | A | | 1/2020 | |
| CN | 110701771 | A | | 1/2020 | |
| CN | 110701772 | A | | 1/2020 | |
| CN | 111140914 | A | | 5/2020 | |
| CN | 111140915 | A | | 5/2020 | |
| CN | 111189114 | A | | 5/2020 | |
| CN | 111189115 | A | | 5/2020 | |
| CN | 211400031 | U | | 9/2020 | |
| WO | WO-2019052193 | A1 | * | 3/2019 | ..... F24F 1/00 |
| WO | WO-2020062850 | A1 | * | 4/2020 | ..... F24F 1/0011 |

OTHER PUBLICATIONS

International Search Report dated Feb. 20, 2021 received in International Application No. PCT/CN2020/128956.
Notification of the First Office Action dated Aug. 31, 2023 received in Chinese Patent Application No. CN 202010061302.5.

* cited by examiner

AIR CONDITIONER, CONTROL METHOD FOR AIR CONDITIONER, AND COMPUTER-READABLE STORAGE MEDIUM

CROSS-REFERENCE TO RELATED APPLICATIONS

This application is a continuation application of PCT International Patent Application No. PCT/CN2020/128956, filed on Nov. 16, 2020, which claims priority to and benefits of Chinese Patent Application No. 202010061302.5 filed on Jan. 19, 2020 and Chinese Patent Application No. 202020121594.2 filed on Jan. 19, 2020, the entire contents of which are herein incorporated by reference for all purposes. No new matter has been introduced.

FIELD

The present disclosure relates to the field of air conditioners, and in particular, to an air conditioner, a control method for an air conditioner, and a computer-readable storage medium.

BACKGROUND

At present, the air supplied by an air conditioner in the related art is directed to a specific direction through an air deflector, and the air supplied by the air conditioner can be readily blown directly to the body of a user, resulting in poor user experience.

SUMMARY

The present disclosure aims to solve at least one of the problems in the prior art or related art.

To this end, according to a first aspect of the present disclosure, an air conditioner is provided.

According to a second aspect of the present disclosure, a control method for an air conditioner is provided.

According to a third aspect of the present disclosure, a computer-readable storage medium is provided.

In view of this, according to the first aspect of the present disclosure, an air conditioner is provided, wherein the air conditioner comprises: a shell, wherein the shell is provided with an opening portion; a first air deflector, wherein the first air deflector is connected to the shell, and an air outlet is defined by the first air deflector and the opening portion; and an air-scattering assembly, wherein an air-scattering component is arranged on the air-scattering assembly, the air-scattering component is suitable for allowing an airflow to pass therethrough, and is suitable for enabling the passing airflow to diffuse and flow, and the air-scattering assembly is suitable for moving relative to the shell and opens or closes the air outlet by means of movement.

For the air conditioner provided by the present disclosure, the air outlet is defined by the first air deflector and the shell, and the air-scattering assembly can open or close the air outlet. When the air conditioner is turned off, the air-scattering assembly and the shell can form the exterior of the air conditioner, and avoid exposing the air outlet. During a working process, external air enters the air conditioner for heat exchanging and then can be directly discharged through the air outlet defined between the first air deflector and the shell for cooling or heating, and can also be discharged via the air outlet after the air-scattering component diffuses supplied air, and thus, different working modes are provided, the user is provided with more operational options, and user experience is improved.

For the air conditioner provided by the present disclosure, through the arrangement of the first air deflector and the air-scattering assembly, when the air conditioner does not work, the air outlet can be closed by the air-scattering assembly. The air-scattering assembly, the first air deflector and the shell have an integrated appearance, and this can improve the grade of a product.

For the air conditioner provided by the present disclosure, different working modes can be provided through the arrangement that the air-scattering assembly moves relative to the shell and opens or closes the air outlet by means of its movement. In the case that the air-scattering assembly closes the air outlet, the air supplied by the air conditioner is discharged through the air-scattering assembly located at the air outlet, and the air-scattering component of the air-scattering assembly can diffuse the passing airflow, thereby achieving windless air discharge. It can be understood that the original flowing direction of the air is changed via an air-scattering structure and then the air can flow towards different directions, thereby achieving windless air discharge, thus, even if people directly face the air outlet of the air conditioner, they will not feel excessive airflow, which improves user experience. In the case that the air-scattering assembly opens the air outlet, the air supplied by the air conditioner is discharged through the air outlet which is defined by the first air deflector and the opening portion of the shell, the air conditioner supplies air normally, and directly discharging the air supplied by the air conditioner can improve the cooling or heating effect of the air conditioner.

In addition, the above air conditioner provided by the present disclosure can further have the following additional technical features:

In the above embodiment, additionally or alternatively, the opening portion is formed with a notch, and the first air deflector is suitable for covering a portion of the notch and defines the air outlet together with the notch.

In the above embodiment, the shape of the opening portion of the shell and the forming method of the air outlet are further provided. The opening portion is formed with the notch, and the first air deflector is suitable for covering a portion of the notch and defines the air outlet together with the notch. The air conditioner can supply large amounts of air through the notch, thereby improving the cooling or heating effect of the air conditioner.

In any one of the above embodiments, additionally or alternatively, the first air deflector is disposed rotatably, and the first air deflector is suitable for rotating to change the air discharge direction of the air outlet.

In the above embodiment, the first air deflector is disposed rotatably, and this can change the air discharge direction of the air outlet. On the one hand, a user can conveniently control the air supply direction of the air conditioner, and this can prevent supplying air to a body of a user so as to improve comfort level, or the supplied air is made to be oriented toward the body so that the user can feel the cooling or heating effect of the air conditioner as soon as possible; on the other hand, the rotatable arrangement of the first air deflector can be used in combination with the opening or closing action of the air-scattering assembly to provide different working modes, thereby further improving user experience.

For example, the air-scattering assembly closes the air outlet while the first air deflector rotates to change the orientation of the air outlet, so that the air outlet is oriented toward the bottom of the shell to keep airflow away from the body of the user, and the air conditioner can discharge air through the air-scattering component of the air-scattering assembly and can also discharge air through the air outlet, and thus the air resistance of the air supplied by the air conditioner can be lowered in the case that the air conditioner supplies air in a windless manner, and thus the cooling or heating effect of the air conditioner is improved.

For another example, the air-scattering assembly opens the air outlet while the first air deflector rotates to change the orientation of the air outlet, and the shape and the size of the air outlet can be changed, and furthermore, the flow rate of the supplied air is changed in the case of the same air volume. It can be understood that the smaller the air outlet is, the larger the flow rate of the supplied air is, and the larger the air outlet is, the smaller the flow rate of the supplied air is.

In any one of the above embodiments, additionally or alternatively, the first air deflector is disposed slidably, and the first air deflector is suitable for moving between sliding out of the shell and sliding into the shell.

The first air deflector is disposed slidably and thus can slide out of or slide into the shell, and this can relatively adjust the shape of the air outlet. On the one hand, a user can control the air supply direction of the air conditioner conveniently; on the other hand, the slidable arrangement of the first air deflector can be used in combination with the opening or closing action of the air-scattering assembly to provide different working modes, thereby further improving user experience.

For example, the air-scattering assembly closes the air outlet while the first air deflector slides to change the shape of the air outlet. In the case that the air outlet keeps away from the body of the user, the air conditioner can discharge air through the air-scattering component of the air-scattering assembly and can also discharge air through the air outlet, and thus the air resistance of the air supplied by the air conditioner is lowered in the case that the air conditioner supplies air in a windless manner, and the cooling or heating effect of the air conditioner is improved.

In any one of the above embodiments, additionally or alternatively, the first air deflector is suitable for leaning against and cooperating with the air-scattering assembly to fit together and define a cavity, and the cavity is communicated with the air outlet.

Through the forming of the cavity, a large amount of air can be discharged through the cavity, meanwhile, the cavity can have a buffering function to the air supplied by the air conditioner when the air-scattering assembly closes the air outlet, and thus this can improve the air-scattering effect of the air-scattering assembly, and thereby further improves the windless effect of the air supplied by the air conditioner.

In any one of the above embodiments, additionally or alternatively, side openings are respectively formed in both ends of the shell along the length direction of the splicing line of the first air deflector and the air-scattering assembly, and the side openings are communicated with the cavity.

The cavity can be formed with the side openings for discharging air, and airflow is blown out of sides to prevent blowing air directly in front of the body of a user, and thus, windless air discharge is achieved and the overall resistance for air discharge is reduced. Furthermore, the uniformity of room temperature is improved and the user experience of the product is improved.

In any one of the above embodiments, additionally or alternatively, the first air deflector is provided with an air discharge component.

The first air deflector can be provided with the air discharge component, and the air conditioner can discharge air through the air discharge component, thereby preventing blowing air directly in front of the body of the user, and thus, windless air discharge is achieved and the overall resistance for air discharge is reduced. Furthermore, the uniformity of room temperature is improved and the user experience of the product is improved.

For example, the first air deflector can be disposed at the lower portion of the shell, and the air-scattering assembly is provided at the front side of the shell. When the air-scattering assembly closes the air outlet, the air supplied by the air conditioner can be discharged out of the lower portion of the air conditioner via the first air deflector and will not be blown directly towards the body of the user, and the air supplied by the air conditioner can also be discharged after it is diffused through the air-scattering assembly, thereby achieving windless air supply. When the air-scattering assembly opens the air outlet, the air supplied by the air conditioner can be discharged out of the lower portion of the air conditioner via the first air deflector, and the air can also be discharged directly through the air outlet, and thus, the cooling effect and the heating effect of the air conditioner can be improved. It can be understood that when the air-scattering assembly opens the air outlet, the air outlet is in an uncovered state, then the air supplied by the air conditioner is preferably discharged through the air outlet, and the air discharge component on a first guide plate plays a role of reducing air resistance.

In any one of the above embodiments, additionally or alternatively, the air discharge component comprises through holes; or the air discharge component comprises air outlet grilles; or the air discharge component comprises air-scattering rotary vanes, and the air-scattering rotary vanes are suitable for allowing an airflow to pass therethrough and are suitable for enabling the passing airflow to diffuse and flow.

The air discharge component is further provided, and the air discharge component can comprise at least one of the through holes, the air outlet grilles and the air-scattering rotary vanes. Through the arrangement of the through holes, the air supplied by the air conditioner can be discharged directly via the through holes, thereby reducing the air resistance of the supplied air and improving the cooling or heating effect of the air conditioner. Through the arrangement of the air outlet grilles, the air supply direction is adjusted conveniently when the air supplied by the air conditioner is discharged through the air discharge component. Through the arrangement of the air-scattering rotary vanes, the airflow is enabled to diffuse and flow when the air supplied by the air conditioner is discharged through the air discharge component, and then the air supply direction of the air conditioner can be changed, and windless air supply is achieved.

In any one of the above embodiments, additionally or alternatively, the first air deflector has an air guide surface; wherein at least a portion of the air guide surface is defined as an arc surface, or at least a portion of the air guide surface is defined as a flat surface.

The structure of the first air deflector is further provided. At least a portion of the air guide surface is defined as a concave arc surface, so that the air supplied by the air conditioner can be directed through the concave arc surface. On the one hand, it can be prevented that the air supplied by the air conditioner directly impacts the first air deflector, which results in the attenuation of the flow rate of the supplied air, then the volume of the air supplied by the air conditioner can be ensured and the cooling or heating efficiency of the air conditioner can be improved; on the other hand, the arrangement of the concave arc surface can change the orientation of the air supplied by the air conditioner, and then helps the air conditioner supply air towards an expected direction. For example, when the air conditioner is a hanging air conditioner, through the arrangement of the concave arc surface, a certain angle can be formed between the air supplied by the air conditioner and the wall where the air conditioner is hung, and this makes the user feel more comfortable while improves air supply efficiency, and thus user experience is improved.

In any one of the above embodiments, additionally or alternatively, the air-scattering component comprises: a first fan leaf, wherein the first fan leaf has a first leaf blade; a second fan leaf, wherein the second fan leaf has a second leaf blade; the second fan leaf and the first fan leaf are arranged along an axial direction, the second fan leaf is adapted to rotate, and the second fan leaf is adapted to rotate to a first position and a second position; wherein, when the second fan leaf is located at the first position, the second leaf blade and the first leaf blade are staggered from each other along the axial direction of the air-scattering component; when the second fan leaf is located at the second position, the second leaf blade and the first leaf blade at least partially coincide with each other along the axial direction of the air-scattering component.

The structure of the air-scattering component is further provided. The air-scattering component comprises the first fan leaf and the second fan leaf. The second fan leaf can rotate to be staggered from or partially coincide with the first fan leaf axially, and such an arrangement of the air-scattering component can form different air discharge modes and provide different degrees of air-scattering effects.

For example, when the second fan leaf and the first fan leaf are staggered from each other axially, the gap between the second leaf blade on the second fan leaf and the first leaf blade on the first fan leaf is relatively small, then it is relatively difficult to discharge the air supplied by the air conditioner through the air-scattering assembly, and thus, most of the airflow is discharged through the first air deflector, and can also be discharged through the gap between the first air deflector and the shell. When the second fan leaf and the first fan leaf partially coincide with each other axially, the gap between the second leaf blade on the second fan leaf and the first leaf blade on the first fan leaf is relatively large, the resistance to the airflow when air flows out is relatively small, and the air supplied by the air conditioner can be discharged through the air-scattering component, and the diffusion and the flow of the airflow are achieved by the first leaf blade and the second leaf blade, thereby realizing windless air supply. Furthermore, according to different coinciding areas between the first fan leaf and the second fan leaf, different air-scattering effects can be provided.

In any one of the above embodiments, additionally or alternatively, the air conditioner further comprises a second air deflector, wherein the second air deflector is provided at the air outlet; the second air deflector is adapted to rotate to adjust the air volume flowing out of the air outlet to the first air deflector and the air-scattering assembly.

The air volume of the first air deflector and the air-scattering assembly is adjusted through the rotating of the second air deflector, and thus, the user can reasonably distribute air supply directions and air volumes according to their needs, and the user is provided with more operational options, and thus user experience is improved.

Through the arrangement of the first air deflector, the second air deflector and the air-scattering assembly, different working modes can be provided. For example, when a user has a relatively high requirement for cooling or heating, the air conditioner can be controlled to work in a normal air supply mode, the air-scattering assembly is controlled to open the air outlet, the second air deflector is controlled to rotate, and then the air volume supplied by the air conditioner is distributed towards the air outlet so that air is discharged through the air outlet. When a user has a relatively high requirement for the comfortable level of air supply, the air conditioner can be controlled to work in a windless mode, the air-scattering assembly is controlled to close the air outlet, the second air deflector is controlled to rotate, and then air volume is distributed towards the direction of the air-scattering assembly so that the air is supplied through the air-scattering assembly; the air-scattering assembly can also be controlled to close the air outlet, the second air deflector is controlled to rotate, and then air volume is distributed towards the first air deflector and the air-scattering assembly, so that air is discharged through the first air deflector and the air-scattering assembly at the same time, and this has a function of dividing the air volume of the supplied air, and can reduce or prevent the supplied air from being directly oriented toward the user in a precondition that the total volume of the supplied air is not reduced, and then the cooling or heating effect of the air conditioner can be ensured in a windless state.

In any one of the above embodiments, additionally or alternatively, the air conditioner further comprises that the air conditioner has a first operative configuration, when the air conditioner is in the first operative configuration, the air-scattering assembly closes the air outlet, the second air deflector rotates to a first angle, the second fan leaf is located at the first position, the first air deflector rotates to a second angle or the first air deflector slides to lean against and cooperate with the air-scattering assembly; and/or the air conditioner has a second operative configuration, when the air conditioner is in the second operative configuration, the air-scattering assembly moves to close the air outlet, the second air deflector rotates to a third angle, the second fan leaf is located at the second position, the first air deflector rotates to a fourth angle or the first air deflector slides to lean against and cooperate with the air-scattering assembly; and/or the air conditioner has a third operative configuration, when the air conditioner is in the third operative configuration, the air-scattering assembly moves to open the air outlet, the second air deflector rotates to a fifth angle, the first air deflector rotates to a sixth angle, or the first air deflector slides to open the air outlet; and/or the air conditioner has a fourth operative configuration, when the air conditioner is in the fourth operative configuration, the air-scattering assembly moves to open the air outlet, the second air deflector rotates to a seventh angle, the first air deflector rotates to an eighth angle, or the first air deflector slides to open the air outlet; and/or the air conditioner has a fifth operative configuration, when the air conditioner is in the fifth operative configuration, the air-scattering assembly moves to close the air outlet.

The air conditioner has multiple operative configuration, and this provides the user with more operational options and helps improve user experience.

In the first operative configuration, the air-scattering assembly closes the air outlet, the first air deflector leans against and cooperates with the air-scattering assembly, the second fan leaf is located at the first position, and then the operating mode of the air conditioner is to supply air in a windless manner at the side of the air-scattering assembly, i.e., the airflow flows out of the side of the first air deflector and then diffuses and flows. For example, the air outlet is located in the front portion of the shell, the air-scattering assembly is used to close or open an air supply outlet and is also located at the front portion of the shell; the air outlet is formed between the first air deflector and the shell, the first air deflector is located at the bottom of the shell, the air supplied by the air conditioner is distributed to the first air deflector through the rotation of the second air deflector to the first angle, and the second fan leaf is located at the first position, so that the gap between the second leaf blade on the second fan leaf and the first leaf blade on the first fan leaf is relatively small, and thus it is relatively difficult to discharge the supplied air through the air-scattering assembly; meanwhile, the first air deflector rotates to the second angle or the first air deflector slides to lean against and cooperate with the air-scattering assembly, the gap between the first air deflector and the air-scattering assembly is also relatively small, and thus, most of the airflow is discharged through the first air deflector, and then a windless state is achieved at the front side of the air conditioner; and the first operative configuration is especially suitable for cooling and supplying air when the user is in front of the air conditioner, and this can improve user experience.

In the second operative configuration, the air-scattering assembly closes the air outlet, the first air deflector leans against and cooperates with the air-scattering assembly, the second fan leaf is located at the second position, and then the operating mode of the air conditioner is a windless air supply at the side of the first air deflector, i.e., the airflow flows out of the side of the air-scattering assembly and then diffuses and flows. For example, the air outlet is located in the front portion of the shell, the air-scattering assembly is used to close or open the air supply outlet and is also located at the front portion of the shell, the air outlet is formed between the first air deflector and the shell, the first air deflector is located at the bottom of the shell, the air supplied by the air conditioner is distributed to the air-scattering assembly through the rotation of the second air deflector to the third angle; in addition, the second fan leaf is located at the second position, so that the gap between the second leaf blade on the second fan leaf and the first leaf blade on the first fan leaf is relatively large, and thus the resistance for the airflow flowing out through the air-scattering assembly is relatively small, so that most of the airflow is discharged through the air-scattering assembly, and then a windless state can be achieved at the lower side of the air conditioner; the second operative configuration is especially suitable for cooling and supplying air when the user is located at the bottom of the air conditioner, and this can improve user experience.

In the third operative configuration, the air-scattering assembly opens the air outlet, the second air deflector rotates to the fifth angle, and then the operating mode of the air conditioner is to supply air in a normal cooling mode. For example, the air outlet is located in the front portion of the shell, the air-scattering assembly is used to close or open the air supply outlet and is also located at the front portion of the shell; the air outlet is formed between the first air deflector and the shell, the first air deflector is located at the bottom of the shell, the air-scattering assembly opens the air outlet, the air supplied by the air conditioner is directed towards the air outlet through the rotation of the second air deflector to the fifth angle; the first air deflector rotates to the sixth angle or the first air deflector slides to open the air outlet so that the air outlet is oriented toward the upper portion of the shell, and thus this helps the air conditioner achieve supplying air by deviating to the upper side, and then it is achieved that cool air sinks uniformly while does not blow directly; and the third operative configuration is especially suitable for the cooling mode and can improve user experience.

In the fourth operative configuration, the air-scattering assembly opens the air outlet, the second air deflector rotates to the seventh angle, the first air deflector rotates to the eighth angle or the first air deflector slides to open the air outlet, and then the operating mode of the air conditioner is to supply air in a heating mode. For example, the air outlet is located in the front portion of the shell, the air-scattering assembly is used to close or open the air supply outlet and is also located at the front portion of the shell; the air outlet is formed between the first air deflector and the shell, the first air deflector is located at the bottom of the shell, the air supplied by the air conditioner is distributed to the direction of the first air deflector through the rotation of the second air deflector to the seventh angle; the first air deflector rotates to the eighth angle or the first air deflector slides to open the air outlet so that the air outlet is oriented toward the lower side of the air conditioner, and thus this helps the air conditioner achieve supplying air by deviating to the lower side, thereby achieving the pressing down hot air; and the fourth operative configuration is especially suitable for the heating mode and can improve user experience.

In the fifth operative configuration, the air-scattering assembly moves to close the air outlet. When the air conditioner is working, the supplied air is discharged through the air-scattering assembly, and windless air supply can be achieved. When the air conditioner is turned off, the air-scattering assembly covers the air outlet, and the air-scattering assembly, the first air deflector and the shell have an integrated appearance, and thus the grade of the product is improved.

In any one of the above embodiments, additionally or alternatively, the shell comprises an accommodating portion, and at least a portion of the air-scattering assembly is accommodated in the accommodating portion.

The shell can further comprise the accommodating portion, and at least a portion of the air-scattering assembly is accommodated in the accommodating portion. The accommodating portion can have a function of fixing and accommodating the air-scattering assembly, and prevent the air-scattering assembly from breaking away from the air conditioner due to the pushing function of the supplied air when the air supplied by the air conditioner flows through the air-scattering assembly, thereby improving the service life of the air conditioner, reducing the frequency of repair and maintenance, and further improving the user experience of the product.

In any one of the above embodiments, additionally or alternatively, the accommodating portion comprises an accommodating groove, and the air-scattering assembly is slidably connected with the accommodating groove, wherein the air-scattering assembly slides relative to the accommodating groove to extend out of the accommodating groove or to be accommodated in the accommodating groove.

The accommodating portion can further comprise the accommodating groove, and the air-scattering assembly is slidably connected with the accommodating groove, wherein the air-scattering assembly can slide relative to the accommodating groove to extend out of the accommodating groove or to be accommodated in the accommodating groove. The accommodating groove has a simple structure and can be easily manufactured, and thus this helps reduce the costs of manufacturing. The air-scattering assembly is slidably connected with the accommodating groove, and thus, when the air-scattering assembly is accommodated in the accommodating groove, the diffusing function of the air-scattering assembly to the supplied air is alleviated, so that the air conditioner supplies air normally, and when the air-scattering assembly extends out of the accommodating groove, the air-scattering assembly can be made to slide into the accommodating groove to achieve accommodating the air-scattering assembly, and can also slide out of the accommodating groove to form a cavity in combination with the air guide portion to achieve windless air discharge, and thus the air conditioner is used more conveniently.

In any one of the above embodiments, additionally or alternatively, the shell further comprises a surface frame and a surface plate, the opening portion is formed in the surface frame, and the accommodating portion is defined by the surface plate and the surface frame; wherein the accommodating portion is disposed in the front portion of the shell.

The shell can further comprise the surface plate, and the arrangement position of the accommodating portion is further provided. The arrangement of the surface plate is conducive to the formation of the accommodating portion, and meanwhile makes the appearance of the air conditioner more attractive. The accommodating portion is disposed in the front portion of the shell, and thus the air-scattering assembly can be accommodated in the front side of the shell; when the air conditioner starts the windless air charge mode, the air-scattering assembly extends directly from the accommodating portion in the front side of the shell to form a cavity in combination with a first carrier; in addition, providing the accommodating portion in the front side of the shell avoids the increasing of the height of the air conditioner.

According to the second aspect of the present disclosure, a control method for an air conditioner is provided, which is used for the air conditioner in any one of the above embodiments, and the control method comprises: receiving a control instruction, and controlling the air-scattering assembly to move to open or close the air outlet according to the control instruction.

According to the control method for the air conditioner provided by the present disclosure, through receiving a control instruction, the air-scattering assembly is further controlled to move to open or close the air outlet according to the control instruction, when the air conditioner is turned off, the air-scattering assembly of the air conditioner can be controlled to close the air outlet, so that the air-scattering assembly and the air conditioner form an integrated appearance; meanwhile, when the air conditioner is turned on, in the state that the air-scattering assembly closes the air outlet, the windless air supply mode can be achieved through the air-scattering assembly or the air-scattering assembly of the air conditioner is controlled to open the air outlet, and then the air supplied by the air conditioner is discharged directly through the air outlet, and this can improve the cooling or heating effect of the air conditioner; meanwhile, when the air conditioner does not work, the air-scattering assembly can also be controlled to close the air outlet through the control instruction, and thus, the air-scattering assembly, the first air deflector and the shell have an integrated appearance, which can improve the grade of the product.

For example, the control instruction can comprise multiple instructions, for example, a shutdown instruction and a starting instruction. The starting instruction may further comprise a heating instruction and a cooling instruction. The cooling instruction further comprises a normal air supply instruction and a windless air supply instruction. The windless air supply instruction further comprises a front side windless air supply instruction and a lower side windless air supply instruction. Wherein, the shutdown instruction and the windless air supply instruction are used to control the air-scattering assembly to move to close the air outlet; and the normal air supply instruction and the heating instruction are used to control the air-scattering assembly to move to open the air outlet.

In addition, the control method for the above air conditioner provided by the present disclosure can further have the following additional technical features.

In the above embodiment, additionally or alternatively, the control instruction comprises a first instruction, and a step of receiving the control instruction and controlling the air-scattering assembly to move to open or close the air outlet according to the control instruction comprises: receiving the first instruction, and controlling the air-scattering assembly to close the air outlet according to the first instruction.

The first instruction is received and the air-scattering assembly is controlled to close the air outlet according to the first instruction. For example, the first instruction can be a front side windless air supply instruction, and is used to control the air-scattering assembly to close the air outlet to achieve a windless feel at the side of the air-scattering assembly of the air conditioner.

In any one of the above embodiments, additionally or alternatively, after the step of receiving a first instruction and controlling the air-scattering assembly to close the air outlet according to the first instruction, they further comprise: controlling the second air deflector of the air conditioner to rotate to the first angle, controlling the first air deflector to rotate to the second angle, and controlling the second fan leaf of the air conditioner to be at the first position; or controlling the second air deflector of the air conditioner to rotate to the first angle, controlling the first air deflector to slide to lean against and cooperate with the air-scattering assembly, and controlling the second fan leaf to be at the first position.

A step following the step of receiving a first instruction and controlling the air-scattering assembly to close the air outlet according to the first instruction is further provided. Through the embodiment, the air supplied by the air conditioner can be preferably directed downwardly, and windless air supply can be achieved at the front side. For example, the air outlet is disposed in the front portion of the shell, the air-scattering assembly is used to close or open the air outlet and is also disposed at the front portion of the shell, the air outlet is formed between the first air deflector and the shell, the first air deflector is disposed at the bottom of the shell; the air supplied by the air conditioner is distributed to the first air deflector through the rotation of the second air deflector to the first angle; in addition, the second fan leaf is located at the first position, so that the gap between the second leaf blade on the second fan leaf and the first leaf blade on the first fan leaf is relatively small, and thus it is relatively difficult to discharge the supplied air through the air-scattering assembly; meanwhile, the first air deflector rotates to the second angle or the first air deflector slides to lean against and cooperate with the air-scattering assembly, the gap between the first air deflector and the air-scattering assembly is also relatively small, and thus, most of the airflow is discharged through the first air deflector, and a windless state can be achieved at the front side of the air conditioner, and this can improve user experience.

In any one of the above embodiments, additionally or alternatively, the control instruction comprises a second instruction, and a step of receiving the control instruction and controlling the air-scattering assembly to move to open or close the air outlet according to the control instruction comprises: receiving the second instruction, and controlling the air-scattering assembly to move to close the air outlet according to the second instruction.

The second instruction is received and the air-scattering assembly is controlled to close the air outlet according to the second instruction. For example, the second instruction can be the lower side windless air supply instruction, and is used to control the air-scattering assembly to close the air outlet to achieve a windless feel at the side of the first air deflector of the air conditioner.

In any one of the above embodiments, additionally or alternatively, after the step of receiving a second instruction and controlling the air-scattering assembly to move to close the air outlet according to the second instruction, they further comprise: controlling the second air deflector of the air conditioner to rotate to the third angle, controlling the first air deflector to rotate to the fourth angle, and controlling the second fan leaf of the air conditioner to be at the second position; or controlling the second air deflector of the air conditioner to rotate to the third angle, controlling the first air deflector to slide to lean against and cooperate with the air-scattering assembly, and controlling the second fan leaf to be at the second position.

A step following the step of receiving a second instruction and controlling the air-scattering assembly to move to close the air outlet according to the second instruction is further provided. Through the embodiment, the air supplied by the air conditioner can be preferably directed forwardly, and windless air supply can be achieved at the lower side. For example, the air outlet is disposed in the front portion of the shell, the air-scattering assembly is used to close or open the air supply outlet and is also disposed at the front portion of the shell, the air outlet is formed between the first air deflector and the shell, the first air deflector is disposed at the bottom of the shell; the air supplied by the air conditioner is distributed to the air-scattering assembly through the rotation of the second air deflector to the third angle. In addition, the second fan leaf is located at the second position, so that the gap between the second leaf blade on the second fan leaf and the first leaf blade on the first fan leaf is relatively large, and the resistance for the airflow to flow out is relatively small, and therefore, most of the airflow will be discharged through the air-scattering assembly, and then a windless state can be achieved at the lower side of the air conditioner; the second instruction is especially suitable for cooling and supplying air when the user is located at the bottom of the air conditioner, and then user experience can be improved.

In any one of the above embodiments, additionally or alternatively, the control method for the air conditioner further comprises: controlling the second fan leaf to switch between the first position and the second position; wherein the second fan leaf is kept at the first position for a first period of time, and the second fan leaf is kept at the second position for a second period of time.

The second fan leaf switches between the first position and the second position; furthermore, the second fan leaf is kept at the first position for a first period of time, and the second fan leaf is kept at the second position for a second period of time, so that the size of the gap between the second leaf blade on the second fan leaf and the second leaf blade on the first fan leaf changes alternatively, and then the supplied air flowing through the air-scattering component can be cut, and this serves to diffuse the air supplied by the air conditioner, thereby achieving windless air supply and further improving user experience.

In any one of the above embodiments, additionally or alternatively, the control instruction comprises a third instruction, and a step of receiving the control instruction and controlling the air-scattering assembly to move to open or close the air outlet according to the control instruction comprises: receiving the third instruction, and controlling the air-scattering assembly to move to open the air outlet according to the third instruction.

The third instruction is received and the air-scattering assembly is controlled to move to open the air outlet according to the third instruction. For example, the third instruction can be the normal air supply instruction of the cooling instruction, and is used to control the air-scattering assembly to open the air outlet to achieve normal cooling and air supplying of the air conditioner.

In any one of the above embodiments, additionally or alternatively, after the step of receiving the third instruction and controlling the air-scattering assembly to move to open the air outlet according to the third instruction, they further comprise: controlling the second air deflector of the air conditioner to rotate to the fifth angle, and controlling the first air deflector to rotate to the sixth angle; or controlling the second air deflector of the air conditioner to rotate to the fifth angle, and controlling the first air deflector to slide to open the air outlet.

A step following the step of receiving the third instruction and controlling the air-scattering assembly to move to open the air outlet according to the third instruction is further provided. Through the embodiment, normal cooling and air supplying of the air conditioner can be achieved. For example, the air outlet is disposed in the front portion of the shell, the air-scattering assembly is used to close or open the air supply outlet and is also disposed at the front portion of the shell; the air outlet is formed between the first air deflector and the shell, and the first air deflector is disposed at the bottom of the shell; the air supplied by the air conditioner is directed to the air outlet through the rotation of the second air deflector to the fifth angle; the first air deflector rotates to the sixth angle or the first air deflector slides to open the air outlet, so that the air outlet is oriented toward the upper portion of the shell, and this helps the air conditioner achieve supplying air by deviating to the upper side, so that cool air sinks uniformly while does not blow directly, this is especially suitable for the cooling mode and can improve user experience.

In any one of the above embodiments, additionally or alternatively, the control instruction comprises a fourth instruction, and a step of receiving the control instruction and controlling the air-scattering assembly to move to open or close the air outlet according to the control instruction comprises: receiving the fourth instruction, and controlling the air-scattering assembly to move to open the air outlet according to the fourth instruction.

The fourth instruction is received and the air-scattering assembly is controlled to move to open the air outlet according to the fourth instruction. For example, the fourth instruction can be the heating instruction and is used to control the air-scattering assembly to open the air outlet to achieve the heating of the air conditioner.

In any one of the above embodiments, additionally or alternatively, after the step of receiving the fourth instruction and controlling the air-scattering assembly to move to open the air outlet according to the fourth instruction, they further comprise: controlling the second air deflector of the air conditioner to rotate to the seventh angle, and controlling the first air deflector to rotate to the eighth angle; or controlling the second air deflector of the air conditioner to rotate to the seventh angle, and controlling the first air deflector to slide to open the air outlet.

A step following the step of receiving the fourth instruction and controlling the air-scattering assembly to move to open the air outlet according to the fourth instruction is further provided. Through the embodiment, the heating of the air conditioner can be achieved. For example, the air outlet is disposed in the front portion of the shell, the air-scattering assembly is used to close or open the air supply outlet and is also disposed at the front portion of the shell, the air outlet is formed between the first air deflector and the shell, and the first air deflector is disposed at the bottom of the shell; the air supplied by the air conditioner is distributed to the direction of the first air deflector through the rotation of the second air deflector to the seventh angle; the first air deflector rotates to the eighth angle or the first air deflector slides to open the air outlet, so that the air outlet is oriented toward the lower portion of the air conditioner, and this helps the air conditioner achieve supplying air by deviating to the lower side, and then this achieves pressing down hot air, and is especially suitable for the heating mode and can improve user experience.

In any one of the above embodiments, additionally or alternatively, the control instruction comprises a shutdown instruction, and a step of receiving the control instruction and controlling the air-scattering assembly to move to open or close the air outlet according to the control instruction comprises: receiving the shutdown instruction, and controlling the air-scattering assembly to move to close the air outlet according to the shutdown instruction.

The control instruction further comprises the shutdown instruction; when the shutdown instruction is received, the air-scattering assembly is controlled to move to close the air outlet according to the shutdown instruction, and then the air-scattering assembly, the first air deflector and the shell have an integrated appearance, and the grade of the product is improved.

According to the third aspect of the present disclosure, a computer-readable storage medium is provided, wherein a computer program is stored in the computer-readable storage medium, and when the computer program is executed by a processor, the control method for the air conditioner according to any one of the above-mentioned embodiments is implemented.

The computer-readable storage medium according to the third aspect of the present disclosure achieves the control method for the air conditioner in any one of the above embodiments according to the second aspect as the computer program is executed by the processor, and thus has all the technical effects of the control method for the air conditioner in any one of the above embodiments according to the second aspect, which are not repeated herein.

The additional aspects and advantages of the present disclosure will be obvious in the following description, or can be understood through the implementation of the present disclosure.

BRIEF DESCRIPTION OF THE DRAWINGS

The above and/or additional aspects and advantages of the present disclosure will be obvious and understandable from the following description of the embodiments in combination with the accompanying drawings, wherein.

Figure 1:
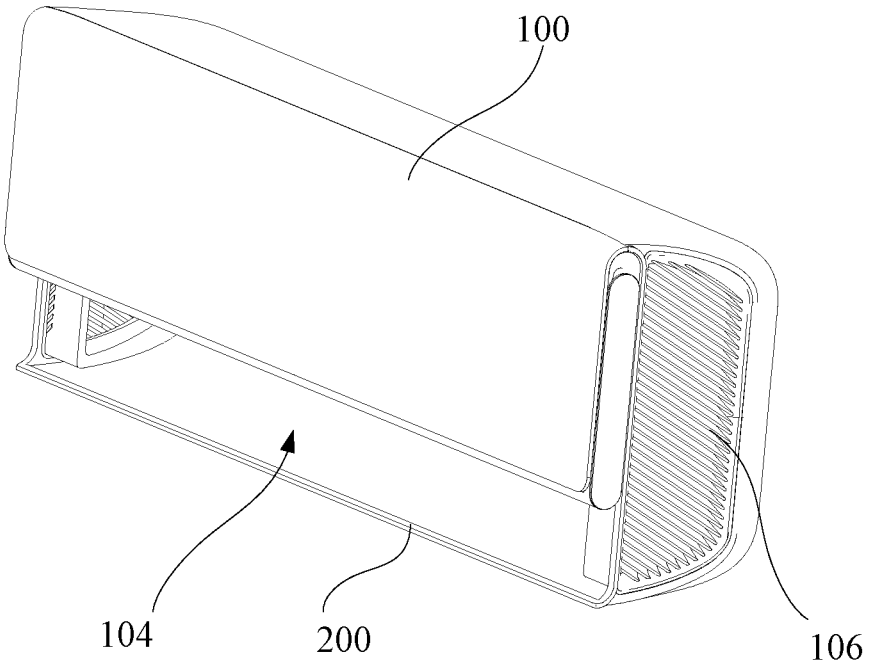
FIG. 1 is a schematic view of an air conditioner according to an exemplary embodiment of a first aspect of the present disclosure.

The corresponding relations between the reference signs in FIG. 1 to FIG. 15 and the names of the components are as follows:

100—shell; 200—first air deflector; 300—air-scattering assembly; 400—second air deflector; 500—chassis; 600—airinlet grille; 700—heat exchanger; 102—opening portion; 104—air outlet; 106—side opening; 110—accommodating portion; 112—accommodating groove; 114—surface frame; 116—surface plate; 202—air guide surface; 302—air-scattering component; 304—first base portion; 306—second base portion; 308—connecting portion; 310—support rod; 3022—first fan leaf; 3024—secondfan leaf; 3082—first connecting piece; 3084—second connecting piece; and 3086—third connecting piece.

DETAILED DESCRIPTION OF THE DISCLOSURE

In order that the above-mentioned objectives, features and advantages of the present disclosure can be understood more clearly, a further detailed description of the present disclosure will be given below in connection with the accompanying drawings and exemplary embodiments. It should be noted that the embodiments of the present disclosure and the features in the embodiments can be combined with each other if there is no conflict.

In the following description, numerous specific details are set forth in order to provide a thorough understanding of the present disclosure. However, the present disclosure can also be implemented in other manners than those described herein. Therefore, the protection scope of the present disclosure is not limited to the exemplary embodiments disclosed below.

Referring to FIG. 1 to FIG. 36, an air conditioner and a control method for an air conditioner according to some embodiments of the present disclosure are described in the following.

As shown in FIG. 1 to FIG. 5, an embodiment of the present disclosure provides an air conditioner, and the air conditioner comprises a shell 100, a first air deflector 200 and an air-scattering assembly 300.

The shell 100 is provided with an opening portion 102; the first air deflector 200 is connected to the shell 100, and an air outlet 104 is defined by the first air deflector 200 and the opening portion 102; and an air-scattering component 302 is arranged on the air-scattering assembly 300. The air-scattering component 302 is suitable for allowing an airflow to pass therethrough, and is suitable for enabling the passing airflow to diffuse and flow, and the air-scattering assembly 300 is suitable for moving relative to the shell 100 and opens or closes the air outlet 104 by means of its movement.

For the air conditioner provided by the present disclosure, the air outlet 104 is defined by the first air deflector 200 and the shell 100, and the air-scattering assembly 300 can open or close the air outlet 104. When the air conditioner is turned off, the air-scattering assembly 300 and the shell 100 can form the exterior of the air conditioner, and avoid exposing the air outlet 104. During a working process, external air enters the air conditioner for heat exchanging and then can be directly discharged through the air outlet 104 defined between the first air deflector 200 and the shell 100 for cooling or heating, and can also be discharged via the air outlet 104 after supplied air is diffused by the air-scattering component 302; and thus, different working modes are provided, the user is provided with more operational options, and thus user experience is improved.

Figure 4:
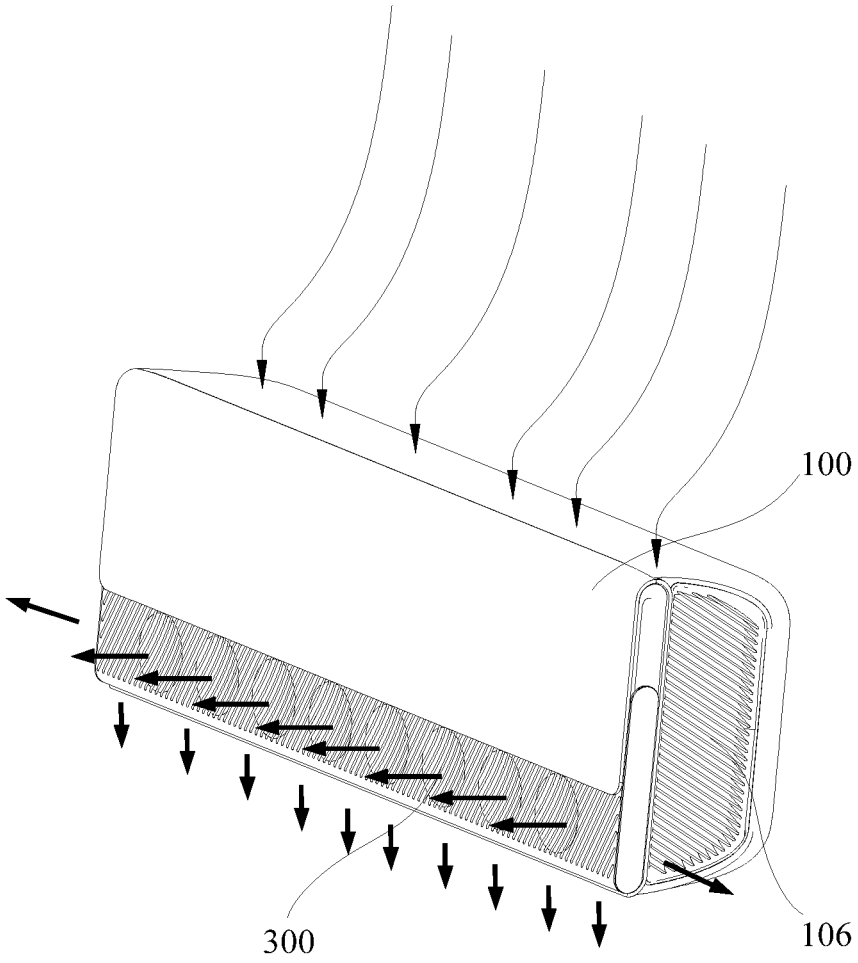
FIG. 4 is a schematic view of the air conditioner when the air conditioner is in a working state.
Figure 5:
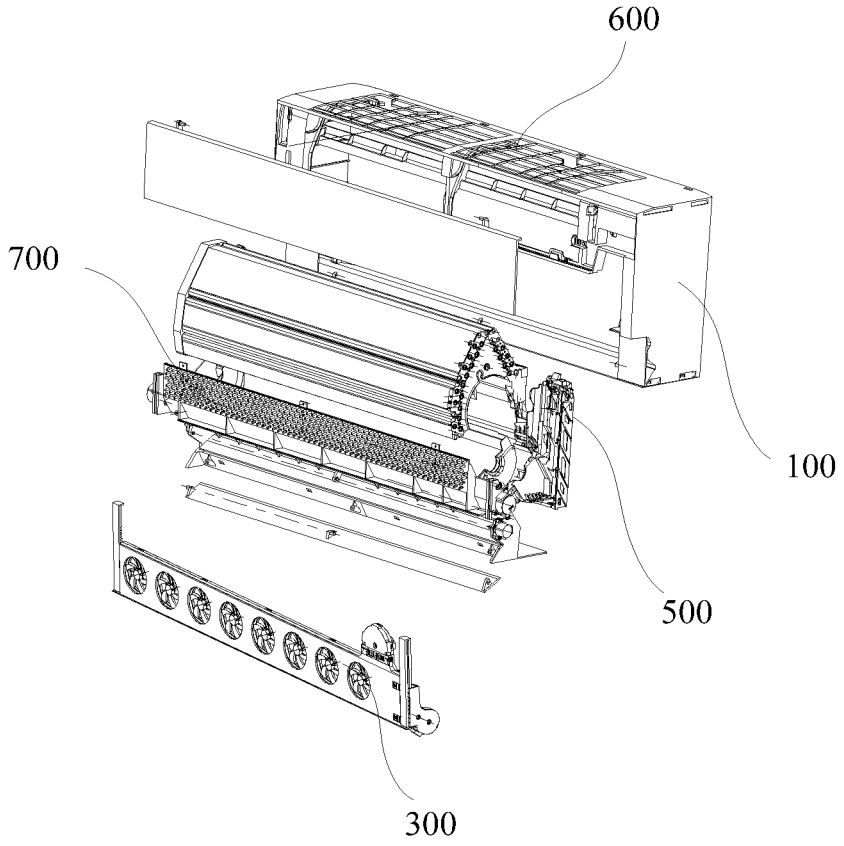
FIG. 5 is a schematic view of an exploded structure of a portion of the air conditioner.

For the air conditioner provided by the present disclosure, as shown in FIG. 4, the arrows which are oriented toward the air conditioner indicate an air inlet direction, and the arrows which are oriented away from the air conditioner indicate an air discharge direction. Through the arrangement of the first air deflector 200 and the air-scattering assembly 300, when the air conditioner does not work, the air outlet 104 can be closed by the air-scattering assembly 300. The air-scattering assembly 300, the first air deflector 200 and the shell 100 have an integrated appearance, and this can improve the grade of a product.

Figure 2:
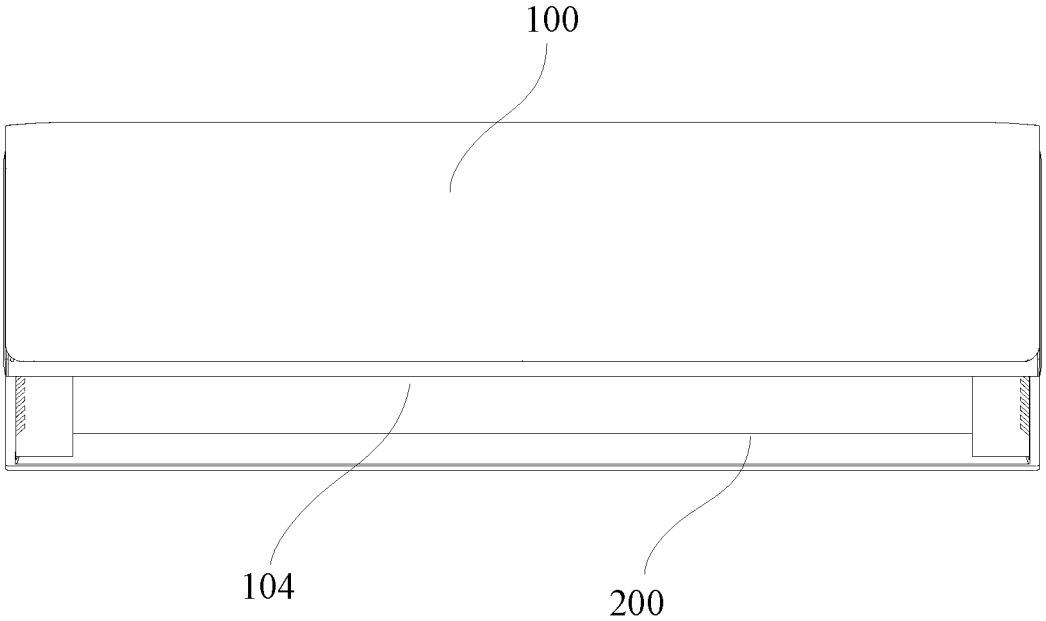
FIG. 2 is a front view of an air-scattering assembly of the air conditioner when the air-scattering assembly opens the air outlet of the air conditioner.
Figure 3:
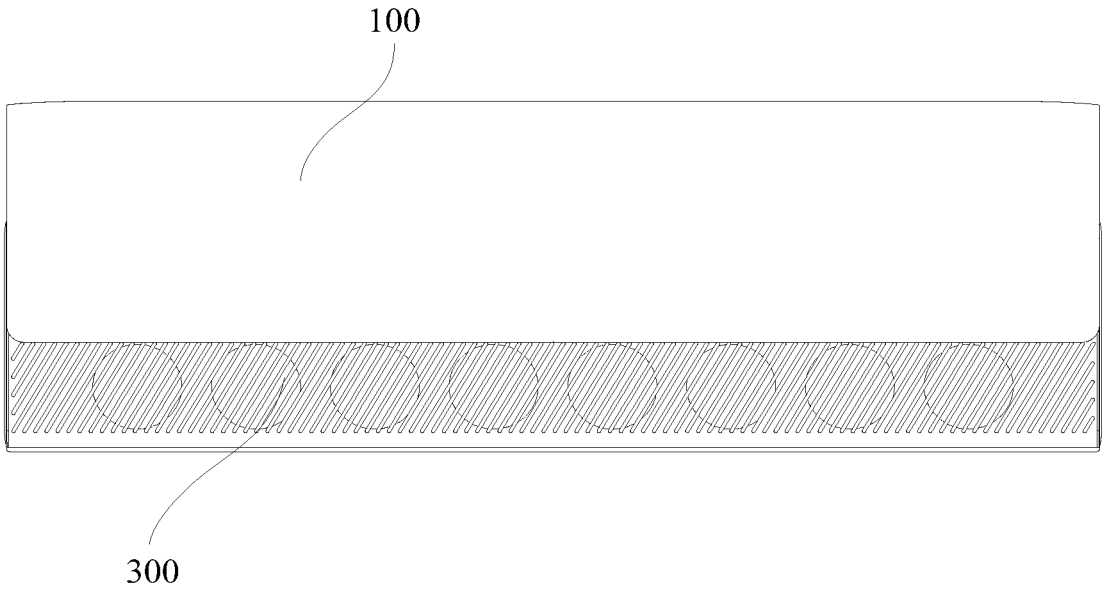
FIG. 3 is a front view of the air-scattering assembly when the air-scattering assembly closes the air outlet.

For the air conditioner provided by the present disclosure, different working modes can be provided through the arrangement that the air-scattering assembly 300 moves relative to the shell 100 and opens or closes the air outlet 104 by means of its movement. As shown in FIG. 3, in the case that the air-scattering assembly 300 closes the air outlet 104, the air supplied by the air conditioner is discharged through the air-scattering assembly 300 located at the air outlet 104, and the air-scattering component 302 of the air-scattering assembly 300 can diffuse the passing airflow, thereby achieving windless air discharge. It can be understood that the original flowing direction of the air is changed via an air-scattering structure and then the air can flow towards different directions, thereby achieving windless air discharge. Thus, even if people directly face the air outlet 104 of the air conditioner, they will not feel excessive airflow, which improves user experience. As shown in FIG. 2, in the case that the air-scattering assembly 300 opens the air outlet 104, the air supplied by the air conditioner is discharged through the air outlet 104 which is defined by the first air deflector 200 And the opening portion 102 of the shell 100, the air conditioner supplies air normally. Directly discharging the air supplied by the air conditioner can improve the cooling or heating effect of the air conditioner. As shown in FIG. 1 to FIG. 5, the shell 100 is provided with an opening portion 102; the first air deflector 200 is connected to the shell 100, and an air outlet 104 is defined by the first air deflector 200 and the opening portion 102; and an air-scattering component 302 is arranged on the air-scattering assembly 300. The air-scattering component 302 is suitable for allowing an airflow to pass therethrough, and is suitable for enabling the passing airflow to diffuse and flow, and the air-scattering assembly 300 is suitable for moving relative to the shell 100 and opens or closes the air outlet 104 by means of movement. Alternatively or additionally, the opening portion 102 is formed with a notch, and the first air deflector 200 is suitable for covering a portion of the notch and defines the air outlet 104 together with the notch.

The shape of the opening portion 102 of the shell 100 and the forming method of the air outlet 104 are further provided. The opening portion 102 is formed with the notch, and the first air deflector 200 is suitable for covering a portion of the notch and defines the air outlet 104 together with the notch. The air conditioner can supply large amounts of air through the notch, thereby improving the cooling or heating effect of the air conditioner.

As shown in FIG. 1 to FIG. 5, the shell 100 is provided with an opening portion 102; the first air deflector 200 is connected to the shell 100, and an air outlet 104 is defined by the first air deflector 200 and the opening portion 102; and an air-scattering component 302 is arranged on the air-scattering assembly 300. The air-scattering component 302 is suitable for allowing an airflow to pass therethrough, and is suitable for enabling the passing airflow to diffuse and flow, and the air-scattering assembly 300 is suitable for moving relative to the shell 100 and opens or closes the air outlet 104 by means of movement.

As shown in FIG. 6 to FIG. 10, the first air deflector 200 is disposed rotatably according to an exemplary embodiment, and the first air deflector 200 is suitable for rotating to change the air discharge direction of the air outlet 104.

The first air deflector 200 is disposed rotatably, and this can change the air discharge direction of the air outlet 104. On the one hand, a user can conveniently control the air supply direction of the air conditioner, and this can either prevent air from being directly supplied to the body of the user so as to improve comfort level, or orient the supplied air toward the body of the user, so that the user can feel the cooling or heating effect of the air conditioner as soon as possible; on the other hand, the rotatable arrangement of the first air deflector 200 can be used in combination with the opening or closing action of the air-scattering assembly 300 to provide different working modes, thereby further improving user experience.

For example, the first air deflector 200 rotates to change the direction of the air outlet 104 while the air-scattering assembly 300 closes the air outlet 104, so that the air outlet 104 is oriented toward the bottom of the shell 100 to keep the airflow away from the body of the user. The air conditioner can discharge air through the air-scattering component 302 of the air-scattering assembly 300 and can also discharge air through the air outlet 104, and thus the air resistance of the air supplied by the air conditioner can be lowered in the case that the air conditioner supplies air in a windless manner, and thus the cooling or heating effect of the air conditioner is improved.

For another example, the first air deflector 200 rotates to change the direction of the air outlet 104 while the air-scattering assembly 300 opens the air outlet 104, and this can change the shape and the size of the air outlet 104. Furthermore, under the condition that the air volume maintains the same, the flow rate of the supplied air can be adjusted. It can be understood that the smaller the air outlet 104 is, the larger the flow rate of the supplied air is; and the larger the air outlet 104 is, the smaller the flow rate of the supplied air is.

As shown in FIG. 1 to FIG. 5, the shell 100 is provided with an opening portion 102; the first air deflector 200 is connected to the shell 100, and an air outlet 104 is defined by the first air deflector 200 and the opening portion 102; and an air-scattering component 302 is arranged on the air-scattering assembly 300. The air-scattering component 302 is suitable for allowing an airflow to pass therethrough, and is suitable for enabling the passing airflow to diffuse and flow, and the air-scattering assembly 300 is suitable for moving relative to the shell 100 and opens or closes the air outlet 104 by means of its movement.

Figure 11:
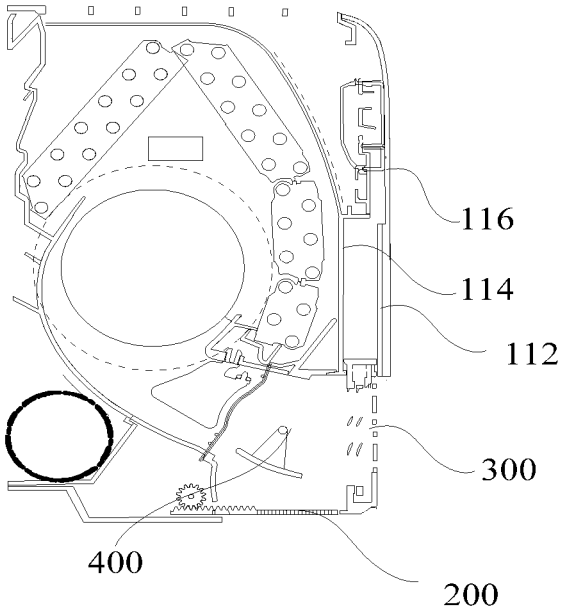
FIG. 11 is a schematic view of a structure of the air conditioner, in which the first air deflector is slidably provided.
Figure 12:
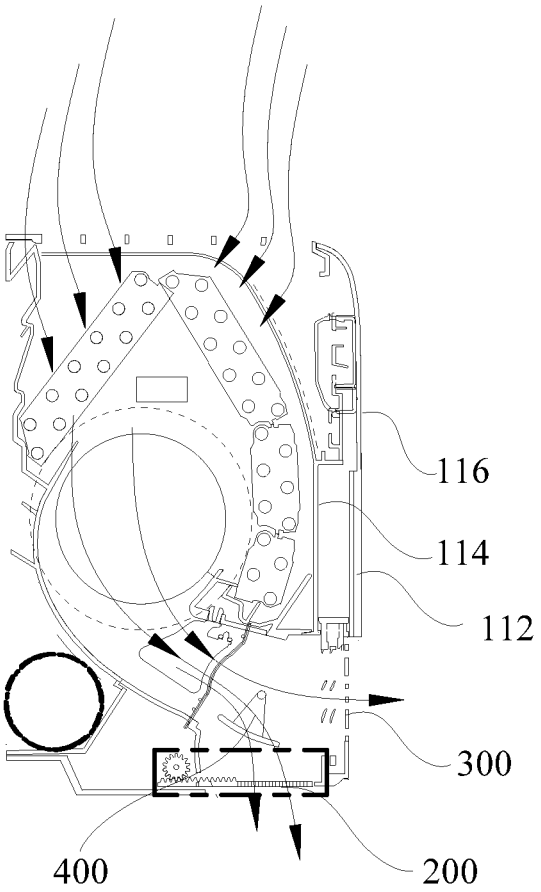
FIG. 12 is a schematic view of the structure of the air conditioner when the air conditioner is working in a normal air supply mode.
Figure 13:
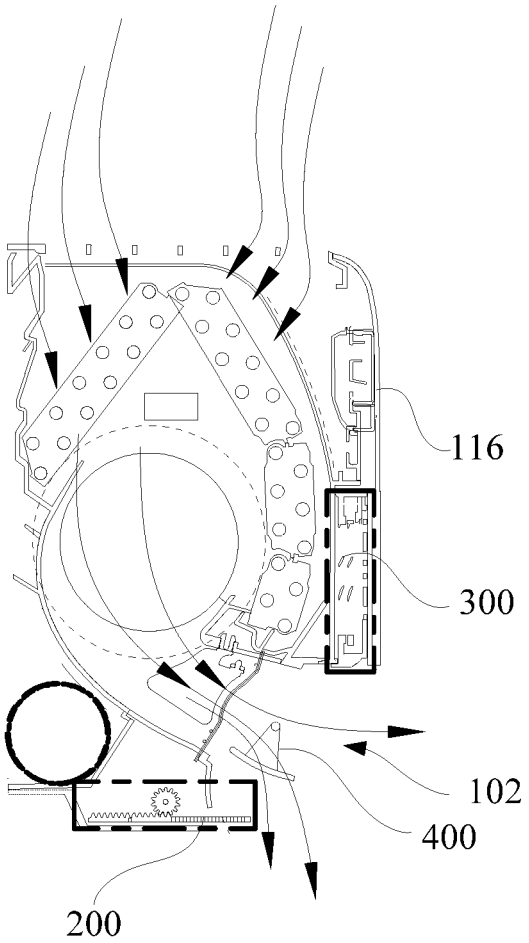
FIG. 13 is a schematic view of the structure of the air conditioner when the air conditioner is working in a windless air supply mode.

As shown in FIG. 11 to FIG. 13, additionally or alternatively, the first air deflector 200 is disposed slidably according to another exemplary embodiment, and the first air deflector 200 can slides into and out of the shell 100. In other words, the first air deflector 200 is suitable for moving between sliding out of the shell 100 and sliding into the shell 100.

In this embodiment, the first air deflector 200 is disposed slidably and thus can slide out of or slide into the shell 100, and this can operatively adjust the shape of the air outlet 104. On the one hand, a user can control the air supply direction of the air conditioner conveniently; on the other hand, the slidable arrangement of the first air deflector 200 can be used in combination with the opening or closing action of the air-scattering assembly 300 to provide different working modes, thereby further improving user experience.

For example, the first air deflector 200 slides to change the shape of the air outlet 104 while the air-scattering assembly 300 closes the air outlet 104. In the case that the air outlet 104 keeps away from the body of the user, as shown in FIG. 13, the arrows which are oriented toward the air conditioner indicate the air inlet direction, and the arrows which are oriented away from the air conditioner indicate an air discharge direction. The air conditioner can discharge air through the air-scattering component 302 of the air-scattering assembly 300 and can also discharge air through the air outlet 104, and thus the air resistance of the air supplied by the air conditioner is lowered in the case that the air conditioner supplies air in a windless manner, and the cooling or heating effect of the air conditioner is improved.

As shown in FIG. 1 and FIG. 4, optionally, side openings 106 can be respectively formed in both ends of the shell 100 along the length direction of the splicing line of the first air deflector 200 and the air-scattering assembly 300, and the side openings 106 are communicated with a cavity.

The cavity can be formed with the side openings 106 for discharging air, and airflow is blown out of sides to prevent blowing the air directly in front of the body of the user, and thus, windless air discharge is achieved and the overall resistance for air discharge is reduced. Furthermore, the uniformity of room temperature is improved and the user experience of the product is improved.

For example, airflow can flow out of the air discharge component on the first air deflector 200, the air-scattering component 302, and the side openings 106 in both sides of the shell 100. Thus, at least four positions for air discharge are formed, which weakens the impact of the airflow while ensuring an air discharge volume. In other words, a 4D windless air discharge can be achieved.

As shown in FIG. 4, optionally, the first air deflector 200 is provided with an air discharge component.

The first air deflector 200 is provided with the air discharge component, and the air conditioner can discharge air through the air discharge component, thereby preventing blowing air directly in front of the body of the user, and thus, windless air discharge is achieved and the overall resistance for air discharge is reduced. Furthermore, the uniformity of room temperature is improved and the user experience of the product is improved.

For example, the first air deflector 200 can be disposed at the lower portion of the shell 100, and the air-scattering assembly 300 is provided at the front side of the shell 100. When the air-scattering assembly 300 closes the air outlet 104, the air supplied by the air conditioner can be discharged out of the lower portion of the air conditioner via the first air deflector 200 and will not be blown directly towards the body of the user, and can also be discharged after it is diffused through the air-scattering assembly 300, thereby achieving windless air supply. When the air-scattering assembly 300 opens the air outlet 104, the air supplied by the air conditioner can be discharged out of the lower portion of the air conditioner via the first air deflector 200, and can also be discharged directly through the air outlet 104, and thus, the cooling effect and the heating effect of the air conditioner can be improved. It can be understood that when the air-scattering assembly 300 opens the air outlet 104, the air outlet 104 is in an uncovered state; in this case, the air supplied by the air conditioner is preferably discharged through the air outlet 104, and the air discharge component on a first guide plate plays a role of reducing air resistance.

Additionally or alternatively, the air discharge component comprises through holes; or the air discharge component comprises air outlet grilles; or the air discharge component comprises air-scattering rotary vanes, and the air-scattering rotary vanes are suitable for allowing an airflow to pass therethrough and are suitable for enabling the passing airflow to diffuse and flow.

The air discharge component can be further provided. The air discharge component can comprise at least one of the through holes, the air outlet grilles and the air-scattering rotary vanes. Through the arrangement of the through holes, the air supplied by the air conditioner can be discharged directly via the through holes, thereby reducing the air resistance of the supplied air and improving the cooling or heating effect of the air conditioner. Through the arrangement of the air outlet grilles, the air supply direction is adjusted conveniently when the air supplied by the air conditioner is discharged through the air discharge component. Through the arrangement of the air-scattering rotary vanes, the airflow is enabled to diffuse and flow when the air supplied by the air conditioner is discharged through the air discharge component, and then the air supply direction of the air conditioner is changed, and windless air supply is achieved.

As shown in FIG. 6 to FIG. 13, optionally, the first air deflector 200 has an air guide surface 202. At least a portion of the air guide surface 202 is defined as an arc surface, or at least a portion of the air guide surface 202 is defined as a flat surface.

The structure of the first air deflector 200 can be further elaborated. At least a portion of the air guide surface 202 is defined as a concave arc surface, so that the air supplied by the air conditioner can be directed through the concave arc surface. On the one hand, it can be prevented that the air supplied by the air conditioner directly impacts the first air deflector 200, which results in the attenuation of the flow rate of the supplied air, then the air supply volume of the air conditioner is ensured and the cooling or heating efficiency of the air conditioner is improved; on the other hand, the arrangement of the concave arc surface can change the orientation of the air supplied by the air conditioner, and then helps the air conditioner supply air towards an expected direction. For example, when the air conditioner is a hanging air conditioner, through the arrangement of the concave arc surface, a certain angle can be formed between the air supplied by the air conditioner and the wall where the air conditioner is hung, and this makes the user feel more comfortable while improving air supply efficiency, and thus user experience is improved.

For example, the air guide surface 202 of the first air deflector 200 is a concave arc surface, i.e., the first air deflector 200 is concaved towards the bottom of the air conditioner, and then the air can be guided above the air conditioner, thereby further preventing the air flowing out of the air outlet from blowing in front of people.

Figure 14:
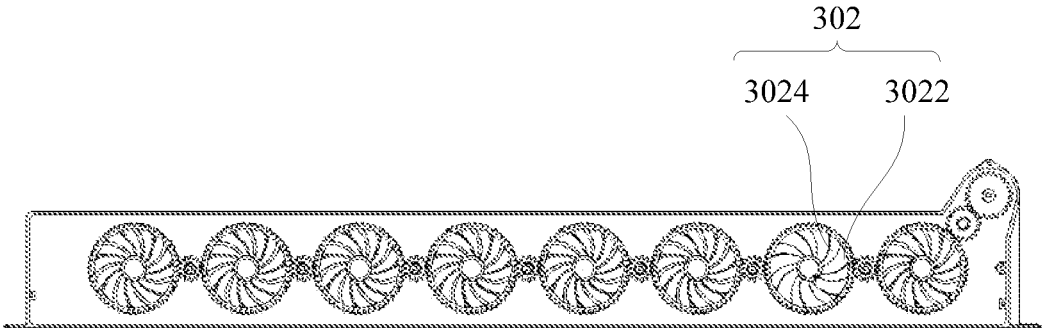
FIG. 14 is a schematic view of an air-scattering assembly of the air conditioner.
Figure 15:
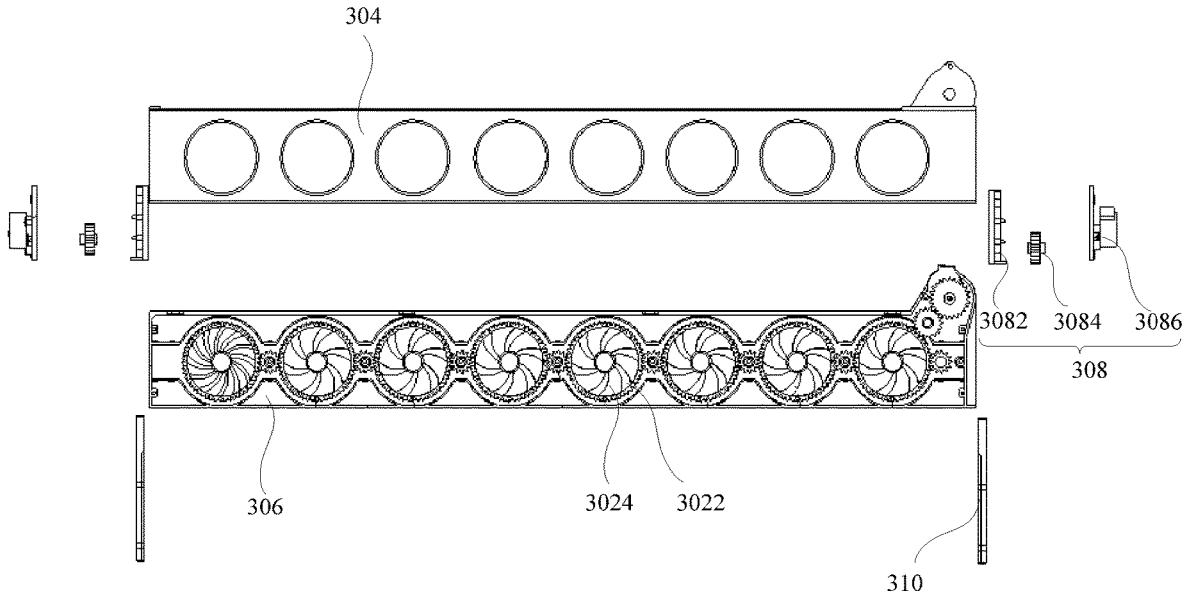
FIG. 15 is a schematic view of an exploded structure of a portion of the air-scattering assembly.

As shown in FIG. 14 and FIG. 15, optionally, the air-scattering component 302 comprises: a first fan leaf 3022 including a first leaf blade; and a second fan leaf 3024 including a second leaf blade. The second fan leaf 3024 and the first fan leaf 3022 are arranged along an axial direction. The second fan leaf 3024 is adapted to rotate, and the second fan leaf 3024 is adapted to rotate to a first position and a second position. When the second fan leaf 3024 is located at the first position, the second leaf blade and the first leaf blade are staggered from each other along the axial direction of the air-scattering component 302; when the second fan leaf 3024 is located at the second position, the second leaf blade and the first leaf blade at least partially coincide with each other along the axial direction of the air-scattering component 302.

The structure of the air-scattering component 302 is further provided. The air-scattering component 302 comprises the first fan leaf 3022 and the second fan leaf 3024. The second fan leaf 3024 can rotate to be staggered from or partially coincide with the first fan leaf 3022 axially, and due to such an arrangement of the air-scattering component 302, different air discharge modes can be formed and different degrees of air-scattering effects can be provided.

For example, when the second fan leaf 3024 and the first fan leaf 3022 are staggered from each other axially, the gap between the second leaf blade on the second fan leaf 3024 and the first leaf blade on the first fan leaf 3022 is relatively small, and then it is relatively difficult to discharge the air supplied by the air conditioner through the air-scattering assembly 300. Thus, most of the airflow is discharged through the first air deflector 200, and can also be discharged through the gap between the first air deflector 200 and the shell 100. When the second fan leaf 3024 and the first fan leaf 3022 partially coincide with each other axially, the gap between the second leaf blade on the second fan leaf 3024 and the first leaf blade on the first fan leaf 3022 is relatively large, the resistance to the airflow when air flows out is relatively small, and the air supplied by the air conditioner can be discharged through the air-scattering component 302, and the diffusion and the flow of the airflow are achieved by the first leaf blade and the second leaf blade, thereby realizing windless air supply. Furthermore, according to different coinciding areas between the first fan leaf 3022 and the second fan leaf 3024, different air-scattering effects can be provided.

As shown in FIG. 14 and FIG. 15, the air-scattering component can be clamped and thus fixed through a first base portion 304 and a second base portion 306, the air-scattering component is supported by a support rod 310, the first base portion 304 is connected with the second base portion 306 through a connecting portion 308, and thus, the structure of the air-scattering assembly 300 can be more stable, and the service life thereof is improved.

Additionally or alternatively, the connecting portion 308 comprises a first connecting piece 3082, a second connecting piece 3084 and a third connecting piece 3086; the second connecting piece 3084 is used to connect a first connection and a second connection; one of the first connecting piece 3082 and the second connection is disposed on the first base portion 304, while the other one is disposed on the second base portion 306.

As shown in FIG. 6 to FIG. 13, the air conditioner can further comprise a second air deflector 400. The second air deflector 400 is provided at the air outlet 104; the second air deflector 400 is adapted to rotate to adjust the air volume flowing out of the air outlet 104 to the first air deflector 200 and the air-scattering assembly 300.

The air volume of the first air deflector 200 and the air-scattering assembly 300 is adjusted through the rotating of the second air deflector 400, and thus, the users can reasonably distribute air supply directions and air volumes according to their needs, and the users are provided with more operational options, and thus user experience is improved.

In this embodiment, through the arrangement of the first air deflector 200, the second air deflector 400 and the air-scattering assembly 300, different working modes can be provided. For example, when a user has a relatively high requirement for cooling or heating, the air conditioner can be controlled to work in a normal air supply mode, the air-scattering assembly 300 is controlled to open the air outlet 104, the second air deflector 400 is controlled to rotate, and then the air volume supplied by the air conditioner is distributed towards the air outlet so that air is supplied through the air outlet 104. When a user has a relatively high requirement for the comfortable level of air supply, the air conditioner can be controlled to work in a windless mode, the air-scattering assembly 300 is controlled to close the air outlet 104, the second air deflector 400 is controlled to rotate, and then air volume is distributed towards the direction of the air-scattering assembly 300 so that the air is supplied through the air-scattering assembly 300; the air-scattering assembly 300 can also be controlled to close the air outlet 104, the second air deflector 400 is controlled to rotate, and then air volume is distributed towards the first air deflector 200 and the air-scattering assembly 300, so that air is discharged through the first air deflector 200 and the air-scattering assembly 300 at the same time. This has a function of dividing the air volume of the supplied air, and can reduce and prevent the supplied air from being directly oriented toward the user in a precondition that the total volume of the supplied air is not reduced, and then the cooling or heating effect of the air conditioner can be ensured in a windless state.

As shown in FIG. 6 to FIG. 13, the air conditioner has a first operative configuration; when the air conditioner is in the first operative configuration, the air-scattering assembly 300 closes the air outlet 104, the second air deflector 400 rotates to a first angle, the second fan leaf 3024 is located at a first position, and the first air deflector 200 rotates to a second angle or the first air deflector 200 slides to lean against and cooperate with the air-scattering assembly 300; and/or the air conditioner has a second operative configuration; when the air conditioner is in the second operative configuration, the air-scattering assembly 300 moves to close the air outlet 104, the second air deflector 400 rotates to a third angle, the second fan leaf 3024 is located at a second position, and the first air deflector 200 rotates to a fourth angle or the first air deflector 200 slides to lean against and cooperate with the air-scattering assembly 300; and/or the air conditioner has a third operative configuration; when the air conditioner is in the third operative configuration, the air-scattering assembly 300 moves to open the air outlet 104, the second air deflector 400 rotates to a fifth angle, and the first air deflector 200 rotates to a sixth angle or the first air deflector 200 slides to open the air outlet 104; and/or the air conditioner has a fourth operative configuration, when the air conditioner is in the fourth operative configuration, the air-scattering assembly 300 moves to open the air outlet 104, the second air deflector 400 rotates to a seventh angle, the first air deflector 200 rotates to an eighth angle, or the first air deflector 200 slides to open the air outlet 104; and/or the air conditioner has a fifth operative configuration; when the air conditioner is in the fifth operative configuration, the air-scattering assembly 300 moves to close the air outlet 104.

The air conditioner has multiple operative configurations, and this provides the user with more operational options and helps improve user experience.

Figure 7:
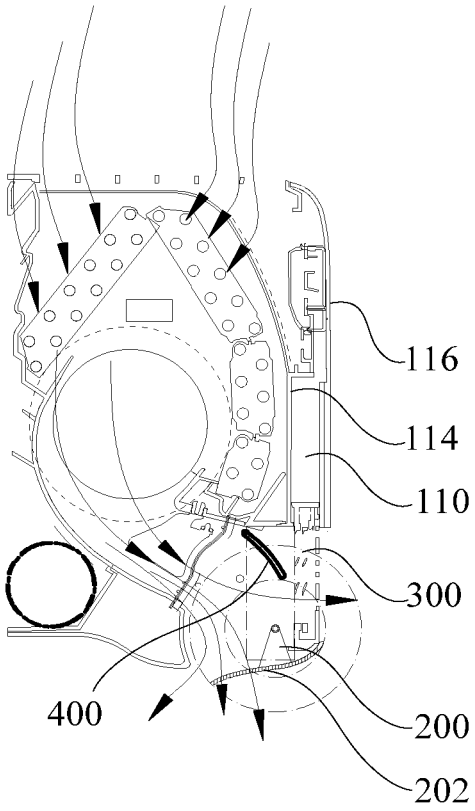
FIG. 7 is a schematic view of the structure of the air conditioner when the air conditioner is in a first operative configuration.

As shown in FIG. 7, in the first operative configuration, the air-scattering assembly 300 closes the air outlet 104, the first air deflector 200 leans against and cooperates with the air-scattering assembly 300, the second fan leaf 3024 is located at the first position, and then the operating mode of the air conditioner is to supply air in a windless manner at the side of the air-scattering assembly 300, i.e., the airflow flows out of the side of the first air deflector 200 and then diffuses and flows. For example, the air outlet 104 is located in the front portion of the shell 100, the air-scattering assembly 300 is used to close or open an air supply outlet and is also located at the front portion of the shell 100; the air outlet 104 is formed between the first air deflector 200 and the shell 100, the first air deflector 200 is located at the bottom of the shell 100, the air supplied by the air conditioner is distributed to the first air deflector 200 through the rotation of the second air deflector 400 to the first angle, and the second fan leaf 3024 is located at the first position, so that the gap between the second leaf blade on the second fan leaf 3024 and the first leaf blade on the first fan leaf 3022 is relatively small, and thus it is relatively difficult to discharge the supplied air through the air-scattering assembly 300; meanwhile, the first air deflector 200 rotates to the second angle or the first air deflector 200 slides to lean against and cooperate with the air-scattering assembly 300, the gap between the first air deflector 200 and the air-scattering assembly 300 is also relatively small, and thus, most of the airflow is discharged through the first air deflector 200, and then a windless state is achieved at the front side of the air conditioner; and the first operative configuration is especially suitable for cooling and supplying air when the user is in front of the air conditioner, and this can improve user experience.

As shown in FIG. 7, the arrows which are oriented toward the air conditioner indicate an air inlet direction, and the arrows which are oriented away from the air conditioner indicate an air discharge direction. The second air deflector 400 rotates to the first angle, the included angle between the second air deflector 400 and the air-scattering assembly 300 towards the extending line of the direction of the accommodating portion in the shell 100 is an acute angle, and the air guide surface of the second air deflector 400 faces the side of the first air deflector 200. The first air deflector 200 rotates to the second angle or the first air deflector 200 slides to lean against and cooperate with the air-scattering assembly 300, an end of the first air deflector 200 abuts the air-scattering assembly 300, so that the gap between the first air deflector 200 and an air guide assembly is relatively small; meanwhile, a gap is formed between the other end of the first air deflector 200 and the shell 100, and thus it is convenient to discharge the supplied air through the lower side of the air conditioner.

In the second operative configuration, the air-scattering assembly 300 closes the air outlet 104, the first air deflector 200 leans against and cooperates with the air-scattering assembly 300, the second fan leaf 3024 is located at the second position, and then the operating mode of the air conditioner is a windless air supply at the side of the first air deflector 200, i.e., the airflow flows out of the side of the air-scattering assembly 300 and is subsequently diffused. For example, the air outlet 104 is located in the front portion of the shell 100, the air-scattering assembly 300 is used to close or open the air supply outlet and is also located at the front portion of the shell 100, the air outlet 104 is formed between the first air deflector 200 and the shell 100, the first air deflector 200 is located at the bottom of the shell 100, the air supplied by the air conditioner is distributed to the air-scattering assembly 300 through the rotation of the second air deflector 400 to the third angle, and in addition, the second fan leaf 3024 is located at the second position, so that the gap between the second leaf blade on the second fan leaf 3024 and the first leaf blade on the first fan leaf 3022 is relatively large. Thus, the resistance for the airflow flowing out through the air-scattering assembly 300 is relatively small, so that most of the airflow is discharged through the air-scattering assembly 300, and then a windless state can be achieved at the lower side of the air conditioner; and the second operative configuration is especially suitable for cooling and supplying air when the user is located at the bottom of the air conditioner, and this can improve user experience.

Figure 8:
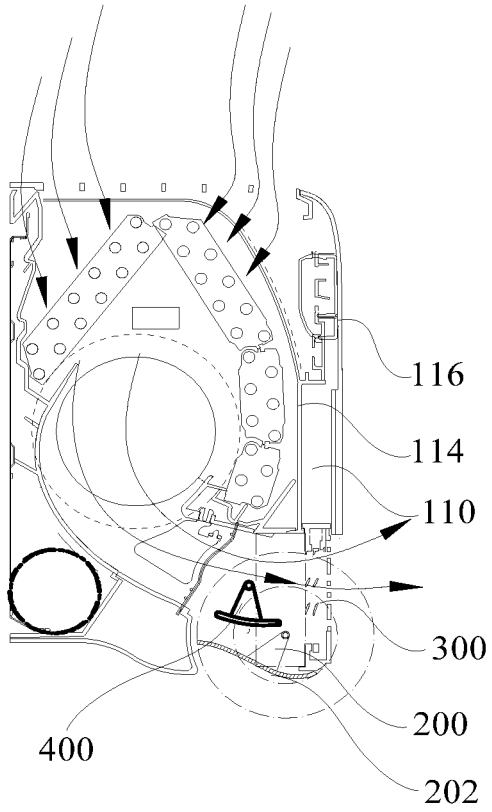
FIG. 8 is a schematic view of the structure of the air conditioner when the air conditioner is in a second operative configuration.

As shown in FIG. 8, the arrows which are oriented toward the air conditioner indicate an air inlet direction, and the arrows which are oriented away from the air conditioner indicate an air discharge direction. The second air deflector 400 rotates to the third angle, the included angle between the second air deflector 400 and the air-scattering assembly 300 towards the extending line of the direction of the accommodating portion in the shell 100 is an obtuse angle or a right angle, and the air guide surface of the second air deflector 400 faces the side of the air-scattering assembly 300. The first air deflector 200 rotates to the fourth angle or the first air deflector 200 slides to lean against and cooperate with the air-scattering assembly 300, an end of the first air deflector 200 abuts the air-scattering assembly 300, and thus it is convenient to discharge the supplied air through the front side of the air conditioner.

In the third operative configuration, the air-scattering assembly 300 opens the air outlet 104, the second air deflector 400 rotates to the fifth angle, and then the operating mode of the air conditioner is to supply air in a normal cooling mode. For example, the air outlet 104 is located in the front portion of the shell 100, the air-scattering assembly 300 is used to close or open the air supply outlet and is also located at the front portion of the shell 100; the air outlet 104 is formed between the first air deflector 200 and the shell 100, the first air deflector 200 is located at the bottom of the shell 100, the air-scattering assembly 300 opens the air outlet 104, the air supplied by the air conditioner is directed towards the air outlet 104 through the rotation of the second air deflector 400 to the fifth angle; the first air deflector 200 rotates to the sixth angle or the first air deflector 200 slides to open the air outlet 104 so that the direction of the air outlet 104 is oriented toward the upper portion of the shell 100. Thus, this helps the air conditioner achieve supplying air by deviating to the upper side, and then it is achieved that cool air sinks uniformly while does not blow directly; and the third operative configuration is especially suitable for the cooling mode and can improve user experience.

Figure 9:
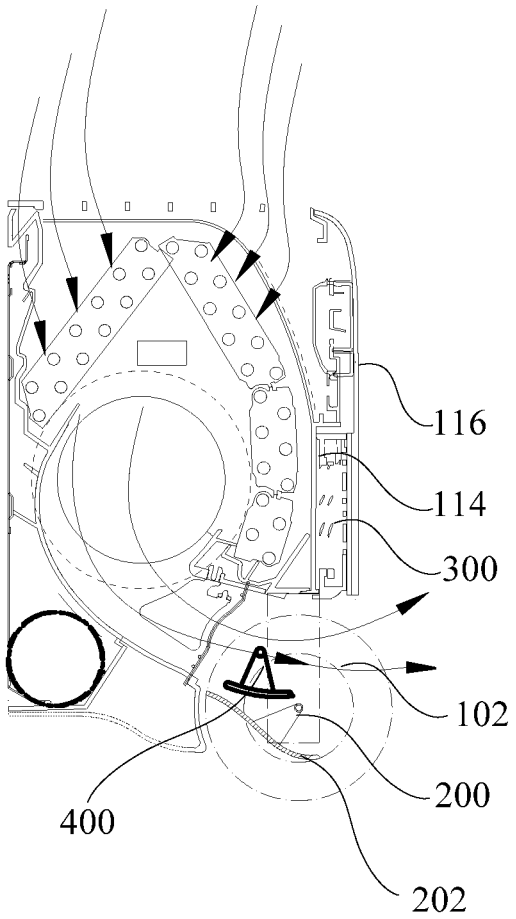
FIG. 9 is a schematic view of the structure of the air conditioner when the air conditioner is in a third operative configuration.

As shown in FIG. 9, the arrows which are oriented toward the air conditioner indicate an air inlet direction, and the arrows which are oriented away from the air conditioner indicate an air discharge direction. The second air deflector 400 rotates to the fifth angle, the included angle between the second air deflector 400 and the air-scattering assembly 300 towards the extending line of the direction of the accommodating portion in the shell 100 is an obtuse angle or a right angle, and the air guide surface of the second air deflector 400 faces the side of the air-scattering assembly 300. The first air deflector 200 rotates to the sixth angle or the first air deflector 200 slides to open the air outlet 104, and thus this helps guide the supplied air through the air outlet 104 in the front side of the air conditioner.

In the fourth operative configuration, the air-scattering assembly 300 opens the air outlet 104, the second air deflector 400 rotates to the seventh angle, the first air deflector 200 rotates to the eighth angle or the first air deflector 200 slides to open the air outlet 104, and then the operating mode of the air conditioner is to supply air in a heating mode. For example, the air outlet 104 is located in the front portion of the shell 100, the air-scattering assembly 300 is used to close or open the air supply outlet and is also located at the front portion of the shell 100; the air outlet 104 is formed between the first air deflector 200 and the shell 100, the first air deflector 200 is located at the bottom of the shell 100, the air supplied by the air conditioner is distributed to the direction of the first air deflector 200 through the rotation of the second air deflector 400 to the seventh angle; the first air deflector 200 rotates to the eighth angle or the first air deflector 200 slides to open the air outlet 104 so that the air outlet 104 is oriented toward the lower side of the shell 100, and thus this helps the air conditioner achieve supplying air by deviating to the lower side, thereby achieving the effect of pressing down hot air; and the fourth operative configuration is especially suitable for the heating mode and can improve user experience.

Figure 10:
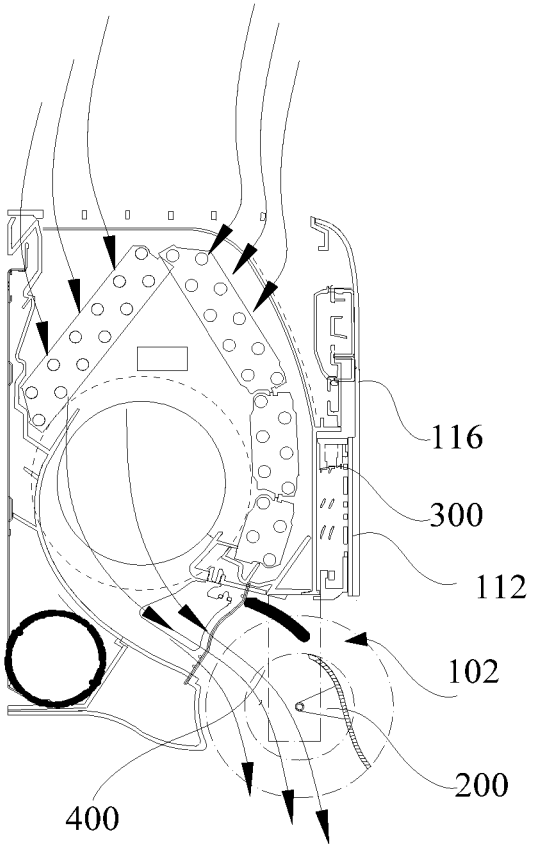
FIG. 10 is a schematic view of the structure of the air conditioner when the air conditioner is in a fourth operative configuration.

As shown in FIG. 10 and FIG. 13, the arrows which are oriented toward the air conditioner indicate an air inlet direction, and the arrows which are oriented away from the air conditioner indicate an air discharge direction. The second air deflector 400 rotates to the seventh angle, the included angle between the second air deflector 400 and the air-scattering assembly 300 towards the extending line of the direction of the accommodating portion in the shell 100 is an acute angle, and the air guide surface of the second air deflector 400 faces the side of the first air deflector 200. The first air deflector 200 rotates to the eighth angle or the first air deflector 200 slides to open the air outlet 104, and thus this helps guide the supplied air towards the lower side of the air conditioner via through air outlet 104.

Figure 6:
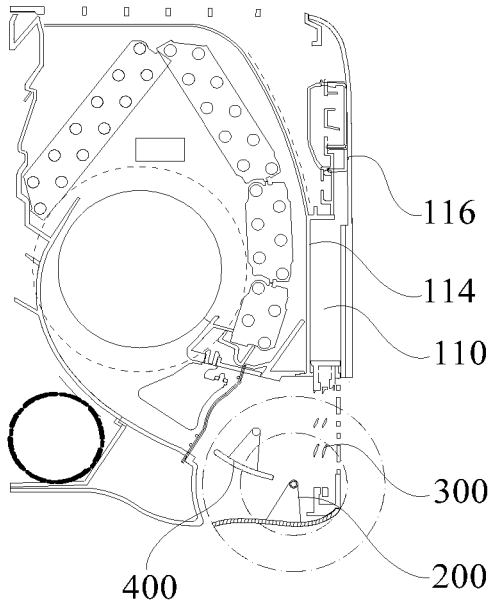
FIG. 6 is a schematic view of a structure of the air conditioner, in which a first air deflector is rotatably provided.

As shown in FIG. 6 and FIG. 11, in the fifth operative configuration, the air-scattering assembly 300 moves to close the air outlet 104. When the air conditioner is working, the supplied air is discharged through the air-scattering assembly 300, and windless air supply can be achieved. When the air conditioner is turned off, the air-scattering assembly 300 covers the air outlet 104, and the air-scattering assembly 300, the first air deflector 200 and the shell 100 have an integrated appearance, and thus the grade of the product is improved.

As shown in FIG. 6 to FIG. 13, optionally, the shell 100 comprises an accommodating portion 110, and at least a portion of the air-scattering assembly 300 is accommodated in the accommodating portion.

The shell 100 can further comprise the accommodating portion 110, and at least a portion of the air-scattering assembly 300 is accommodated in the accommodating portion 110. The accommodating portion 110 can have a function of fixing and accommodating the air-scattering assembly 300, and prevent the air-scattering assembly 300 from breaking away from the air conditioner due to the pushing function of the supplied air when the air supplied by the air conditioner flows through the air-scattering assembly 300, thereby improving the service life of the air conditioner, reducing the frequency of repair and maintenance, and further improving the user experience of the product.

As shown in FIG. 6 to FIG. 13, additionally or alternatively, the accommodating portion 110 comprises an accommodating groove 112, and the air-scattering assembly 300 is slidably connected with the accommodating groove 112. The air-scattering assembly 300 slides relative to the accommodating groove 112 to extend out of the accommodating groove 112 or to be accommodated in the accommodating groove 112.

The accommodating portion 110 can further comprise the accommodating groove 112, and the air-scattering assembly 300 is slidably connected with the accommodating groove 112. The air-scattering assembly 300 can slide relative to the accommodating groove 112 to extend out of the accommodating groove 112 or to be accommodated in the accommodating groove 112. The accommodating groove 112 has a simple structure and can be easily manufactured, and thus this helps reduce the costs of manufacturing. The air-scattering assembly 300 is slidably connected with the accommodating groove 112. Thus, when the air-scattering assembly 300 is accommodated in the accommodating groove 112, the diffusing function of the air-scattering assembly 300 to the supplied air is alleviated, so that the air conditioner supplies air normally; and when the air-scattering assembly 300 extends out of the accommodating groove 112, the air-scattering assembly 300 can be made to slide into the accommodating groove 112 to achieve accommodating the air-scattering assembly 300, and can also slide out of the accommodating groove 112 to form a cavity in combination with the air guide portion and then achieve windless air discharge, and thus the air conditioner is used more conveniently.

As shown in FIG. 6 to FIG. 13, additionally or alternatively, the shell 100 further comprises a surface frame 114 and a surface plate 116, the opening portion 102 is formed in the surface frame 114, and the accommodating portion 110 is defined by the surface plate 116 and the surface frame 114. The accommodating portion 110 is disposed in the front portion of the shell 100.

Figure 16:
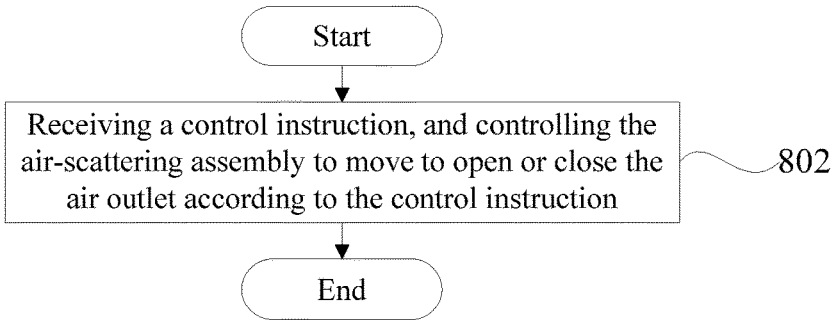
FIG. 16 is a schematic flow diagram of a control method for the air conditioner, according to an exemplary embodiment of a second aspect of the present disclosure.

The shell 100 can further comprise the surface plate 116, and the arrangement position of the accommodating portion 110 is further provided. The arrangement of the surface plate 116 is conducive to the formation of the accommodating portion 110, and meanwhile makes the appearance of the air conditioner more attractive. The accommodating portion 110 is disposed in the front portion of the shell 100, and thus the air-scattering assembly 300 can be accommodated in the front side of the shell 100; when air conditioner starts the windless air discharge mode, the air-scattering assembly 300 extends directly from the accommodating portion 110 in the front side of the shell 100 to form a cavity in combination with a first carrier; in addition, providing the accommodating portion 110 in the front side of the shell 100 avoids the increasing of the height of the air conditioner. As shown in FIG. 16, an embodiment according to another aspect of the present disclosure provides a control method for an air conditioner, which is used for the air conditioner in any one of the above embodiments, and the control method comprises:

Step 802: receiving a control instruction, and controlling the air-scattering assembly to move to open or close the air outlet according to the control instruction.

According to the control method for an air conditioner provided by the present disclosure, through receiving a control instruction, the air-scattering assembly is further controlled to move to open or close the air outlet according to the control instruction. When the air conditioner is turned off, the air-scattering assembly of the air conditioner can be controlled to close the air outlet, so that the air-scattering assembly and the air conditioner form an integrated appearance. When the air conditioner is turned on, in the state that the air-scattering assembly closes the air outlet, the windless air supply mode can also be achieved through the air-scattering assembly or the air-scattering assembly of the air conditioner is controlled to open the air outlet, and then the air supplied by the air conditioner is discharged directly through the air outlet, which improves the cooling or heating effect of the air conditioner. When the air conditioner does not work, the air-scattering assembly can also be controlled to close the air outlet through the control instruction, and thus, the air-scattering assembly, the first air deflector and the shell have an integrated appearance, which can improve the grade of the product.

For example, the control instruction can comprise multiple instructions, for example, a shutdown instruction and a starting instruction. The starting instruction may further comprise a heating instruction and a cooling instruction. The cooling instruction further comprises a normal air supply instruction and a windless air supply instruction. The windless air supply instruction further comprises a front side windless air supply instruction and a lower side windless air supply instruction. The shutdown instruction and the windless air supply instruction are used to control the air-scattering assembly to move to close the air outlet; and the normal air supply instruction and the heating instruction are used to control the air-scattering assembly to move to open the air outlet.

Figure 17:
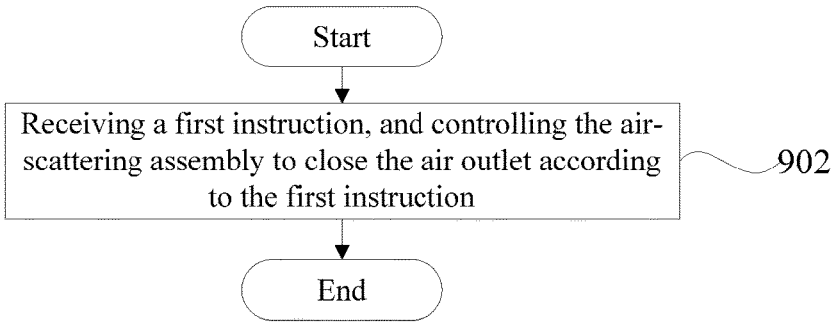
FIG. 17 is another schematic flow diagram of the control method.

As shown in FIG. 17, additionally or alternatively, the control method comprises:

Step 902: receiving a first instruction, and controlling the air-scattering assembly to close the air outlet according to the first instruction.

The first instruction is received and the air-scattering assembly is controlled to close the air outlet according to the first instruction. For example, the first instruction can be a front side windless air supply instruction, and is used to control the air-scattering assembly to close the air outlet to achieve a windless feel at the side of the air-scattering assembly of the air conditioner.

Figure 18:
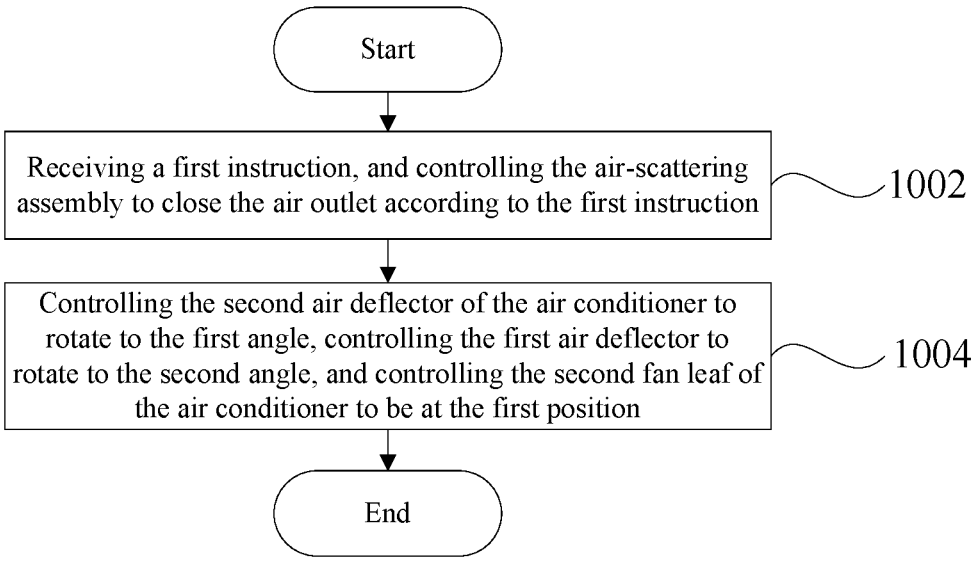
FIG. 18 is another schematic flow diagram of the control method.

As shown in FIG. 18, additionally or alternatively, the control method comprises:

Step 1002: receiving a first instruction, and controlling the air-scattering assembly to close the air outlet according to the first instruction; and Step 1004: controlling the second air deflector of the air conditioner to rotate to the first angle, controlling the first air deflector to rotate to the second angle, and controlling the second fan leaf of the air conditioner to be at the first position.

Figure 19:
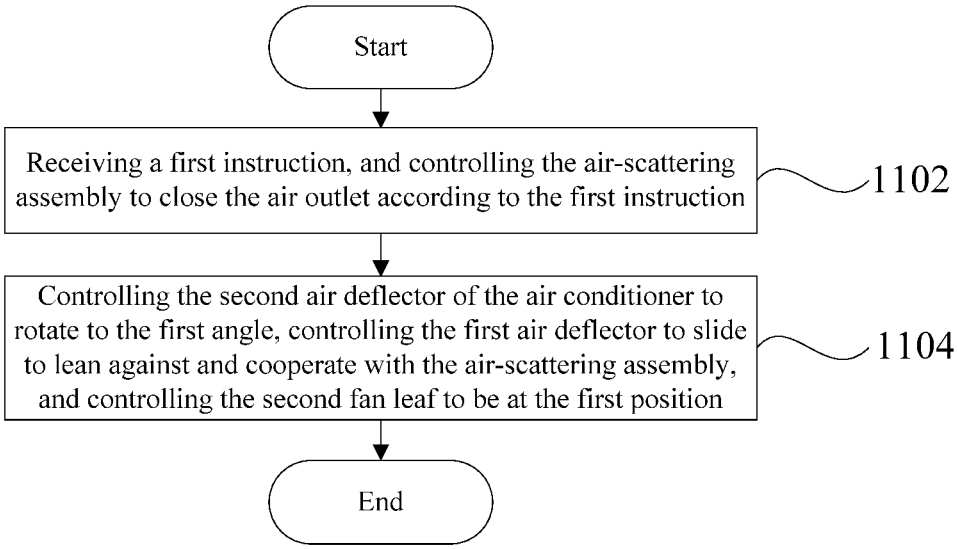
FIG. 19 is another schematic flow diagram of the control method.

As shown in FIG. 19, additionally or alternatively, the control method comprises:

Step 1102: receiving a first instruction, and controlling the air-scattering assembly to close the air outlet according to the first instruction; and Step 1104: controlling the second air deflector of the air conditioner to rotate to the first angle, controlling the first air deflector to slide to lean against and cooperate with the air-scattering assembly, and controlling the second fan leaf to be at the first position.

A step following the step of receiving a first instruction and controlling the air-scattering assembly to close the air outlet according to the first instruction is further provided. The air supplied by the air conditioner can be preferably directed downwardly, and windless air supply can be achieved at the front side. For example, the air outlet is disposed in the front portion of the shell, the air-scattering assembly is used to close or open the air supply outlet and is also disposed at the front portion of the shell, the air outlet is formed between the first air deflector and the shell, the first air deflector is disposed at the bottom of the shell. The air supplied by the air conditioner is distributed to the first air deflector through the rotation of the second air deflector to the first angle, and in addition, the second fan leaf is located at the first position, so that the gap between the second leaf blade on the second fan leaf and the first leaf blade on the first fan leaf is relatively small, and thus it is relatively difficult to discharge the supplied air through the air-scattering assembly. Meanwhile, the first air deflector rotates to the second angle or the first air deflector slides to lean against and cooperate with the air-scattering assembly, the gap between the first air deflector and the air-scattering assembly is also relatively small, and thus, most of the airflow is discharged through the first air deflector, and a windless state can be achieved at the front side of the air conditioner, and this can improve user experience.

Figure 20:
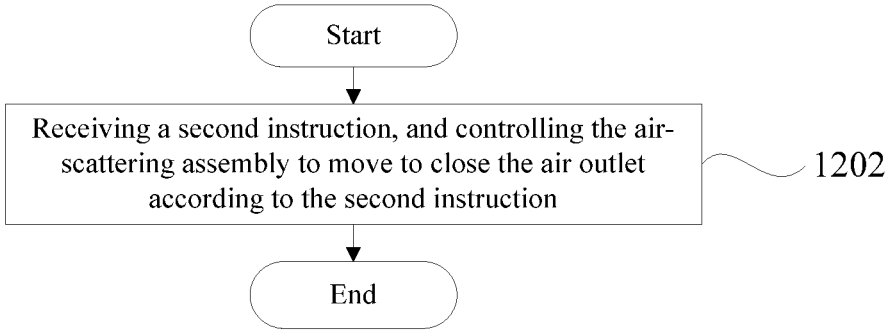
FIG. 20 is another schematic flow diagram of the control method.

As shown in FIG. 20, additionally or alternatively, the control method comprises:

Step 1202: receiving a second instruction, and controlling the air-scattering assembly to move to close the air outlet according to the second instruction.

The second instruction is received and the air-scattering assembly is controlled to close the air outlet according to the second instruction. For example, the second instruction can be a lower side windless air supply instruction, and is used to control the air-scattering assembly to close the air outlet to achieve a windless feel at the side of the first air deflector of the air conditioner.

Figure 21:
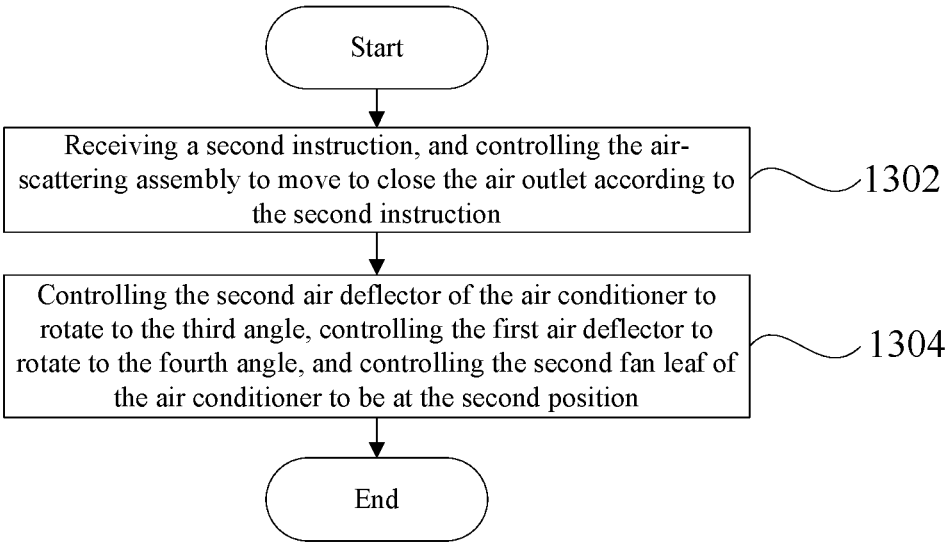
FIG. 21 is another schematic flow diagram of the control method.

As shown in FIG. 21, additionally or alternatively, the control method comprises:

Step 1302: receiving a second instruction, and controlling the air-scattering assembly to move to close the air outlet according to the second instruction; and Step 1304: controlling the second air deflector of the air conditioner to rotate to the third angle, controlling the first air deflector to rotate to the fourth angle, and controlling the second fan leaf of the air conditioner to be at the second position.

Figure 22:
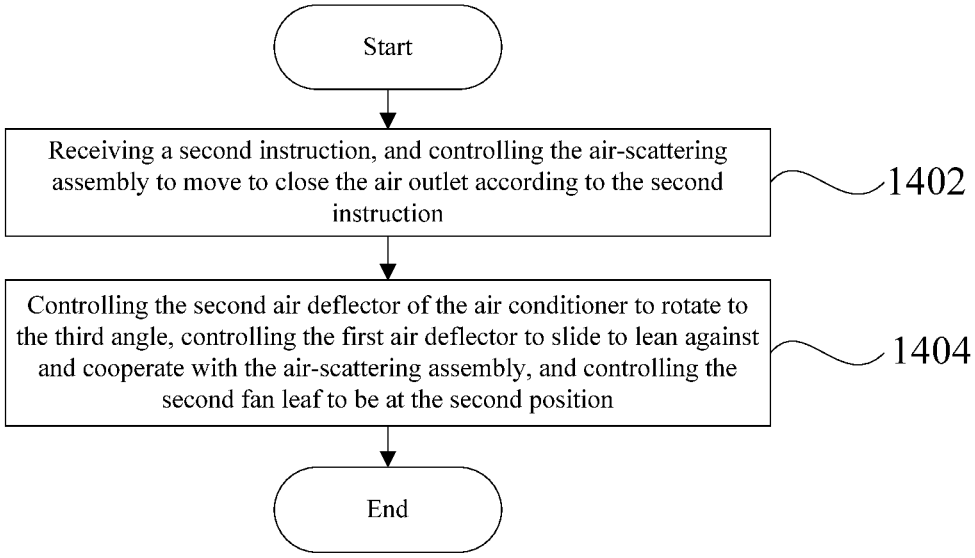
FIG. 22 is another schematic flow diagram of the control method.

As shown in FIG. 22, additionally or alternatively, the control method comprises:

Step 1402: receiving a second instruction, and controlling the air-scattering assembly to move to close the air outlet according to the second instruction; and Step 1404: controlling the second air deflector of the air conditioner to rotate to the third angle, controlling the first air deflector to slide to lean against and cooperate with the air-scattering assembly, and controlling the second fan leaf to be at the second position.

A step following the step of receiving a second instruction and controlling the air-scattering assembly to move to close the air outlet according to the second instruction is further provided. It can be achieved that the air supplied by the air conditioner can be preferably directed forward, and windless air supply can be achieved at the lower side. For example, the air outlet is disposed in the front portion of the shell, the air-scattering assembly is used to close or open the air supply outlet and is also disposed at the front portion of the shell, the air outlet is formed between the first air deflector and the shell, the first air deflector is disposed at the bottom of the shell. The air supplied by the air conditioner is distributed to the air-scattering assembly through the rotation of the second air deflector to the third angle, and the second fan leaf is located at the second position, so that the gap between the second leaf blade on the second fan leaf and the first leaf blade on the first fan leaf is relatively large, and the resistance for the airflow to flow out is relatively small, and therefore, most of the airflow will be discharged through the air-scattering assembly, and then a windless state can be achieved at the lower side of the air conditioner. The second instruction is especially suitable for cooling and supplying air when the user is located at the bottom of the air conditioner, and then user experience can be improved.

Figure 23:
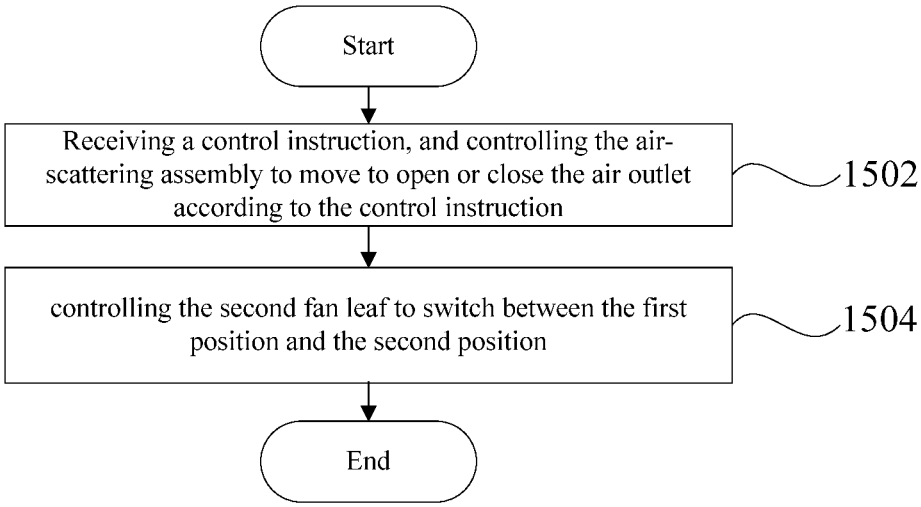
FIG. 23 is another schematic flow diagram of the control method.

As shown in FIG. 23, additionally or alternatively, the control method comprises:

Step 1502: receiving a control instruction, and controlling the air-scattering assembly to move to open or close the air outlet according to the control instruction; and Step 1504: controlling the second fan leaf to switch between the first position and the second position.

The second fan leaf is kept at the first position for a first period of time, and the second fan leaf is kept at the second position for a second period of time.

The second fan leaf switches between the first position and the second position; furthermore, the second fan leaf is kept at the first position for a first period of time, and the second fan leaf is kept at the second position for a second period of time, so that the size of the gap between the second leaf blade on the second fan leaf and the second leaf blade on the first fan leaf changes alternatively, and then the supplied air flowing through the air-scattering component can be cut, and this serves to diffuse the air supplied by the air conditioner, thereby achieving windless air supply and further improving user experience.

Figure 24:
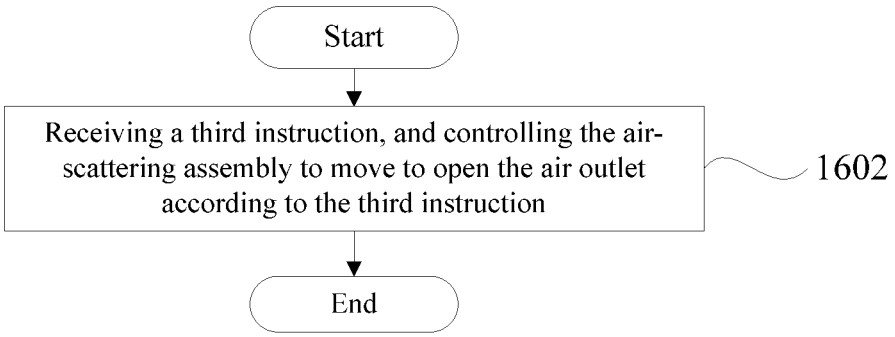
FIG. 24 is another schematic flow diagram of the control method.

As shown in FIG. 24, additionally or alternatively, the control method comprises:

Step 1602: receiving a third instruction, and controlling the air-scattering assembly to move to open the air outlet according to the third instruction.

The third instruction is received and the air-scattering assembly is controlled to move to open the air outlet according to the third instruction. For example, the third instruction can be a normal air supply instruction of the cooling instruction, and is used to control the air-scattering assembly to open the air outlet to achieve normal cooling and air supplying of the air conditioner.

Figure 25:
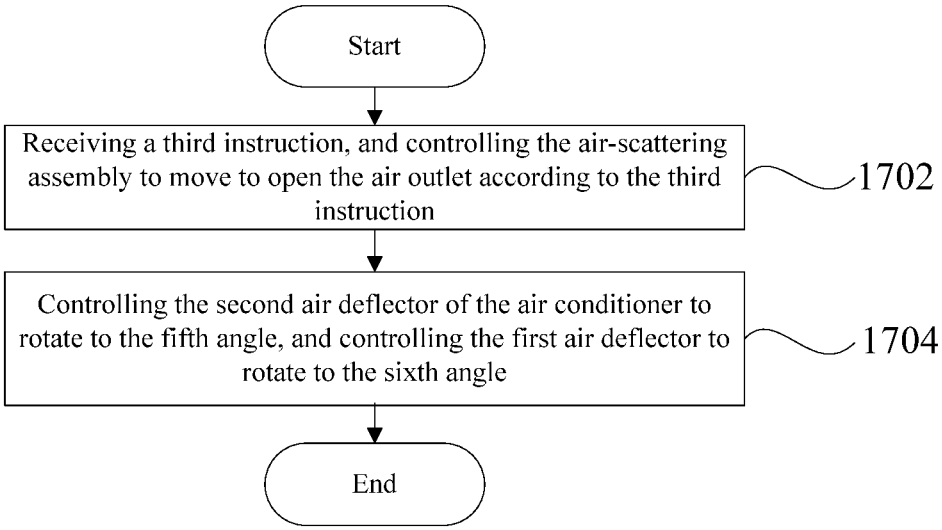
FIG. 25 is another schematic flow diagram of the control method.

As shown in FIG. 25, additionally or alternatively, the control method comprises:

Step 1702: receiving a third instruction, and controlling the air-scattering assembly to move to open the air outlet according to the third instruction; and Step 1704: controlling the second air deflector of the air conditioner to rotate to the fifth angle, and controlling the first air deflector to rotate to the sixth angle.

Figure 26:
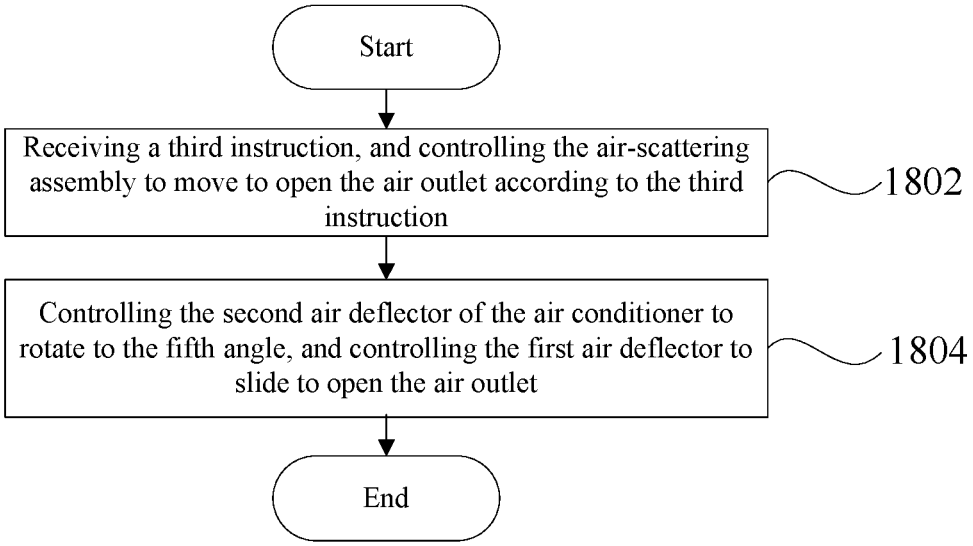
FIG. 26 is another schematic flow diagram of the control method.

As shown in FIG. 26, additionally or alternatively, the control method comprises:

Step 1802: receiving a third instruction, and controlling the air-scattering assembly to move to open the air outlet according to the third instruction; and Step 1804: controlling the second air deflector of the air conditioner to rotate to the fifth angle, and controlling the first air deflector to slide to open the air outlet.

A step following the step of receiving a third instruction and controlling the air-scattering assembly to move to open the air outlet according to the third instruction is further provided. Through the embodiment, normal cooling and air supplying of the air conditioner can be achieved. For example, the air outlet is disposed in the front portion of the shell, the air-scattering assembly is used to close or open the air supply outlet and is also disposed at the front portion of the shell; the air outlet is formed between the first air deflector and the shell, and the first air deflector is disposed at the bottom of the shell; the air supplied by the air conditioner is directed to the air outlet through the rotation of the second air deflector to the fifth angle; the first air deflector rotates to the sixth angle or the first air deflector slides to open the air outlet, so that the air outlet is oriented toward the upper portion of the shell, and this helps the air conditioner achieve supplying air by deviating to the upper side, so that cool air sinks uniformly while does not blow directly, this is especially suitable for the cooling mode and can improve user experience.

Figure 27:
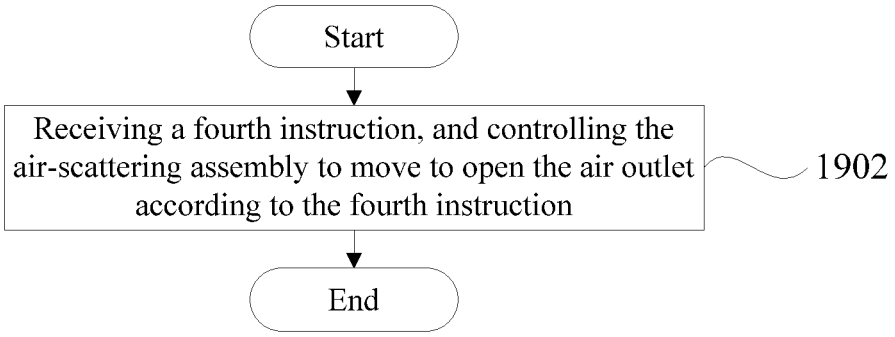
FIG. 27 is another schematic flow diagram of the control method.

As shown in FIG. 27, additionally or alternatively, the control method comprises:

Step 1902: receiving a fourth instruction, and controlling the air-scattering assembly to move to open the air outlet according to the fourth instruction.

The fourth instruction is received and the air-scattering assembly is controlled to move to open the air outlet according to the fourth instruction. For example, the fourth instruction can be the heating instruction and is used to control the air-scattering assembly to open the air outlet to achieve the heating of the air conditioner.

Figure 28:
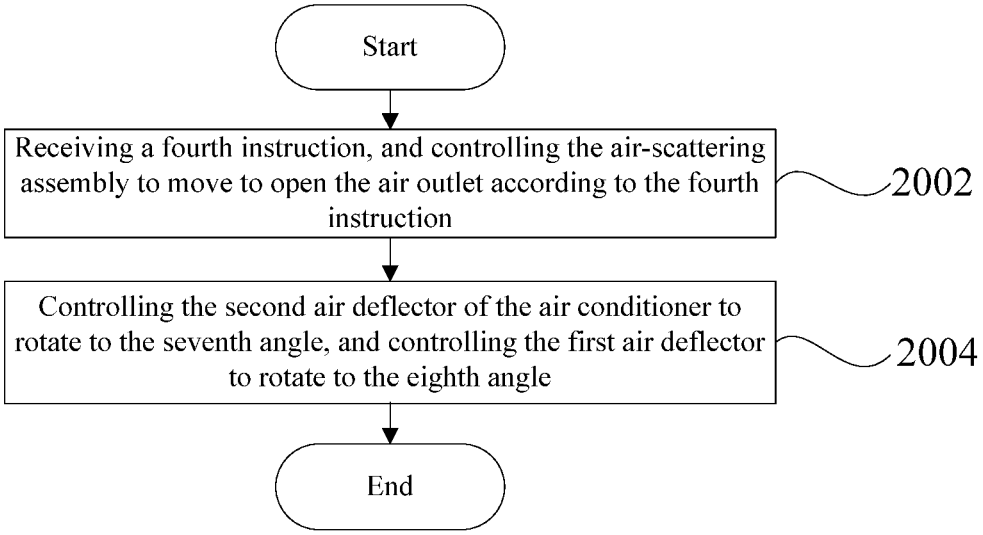
FIG. 28 is another schematic flow diagram of the control method.

As shown in FIG. 28, additionally or alternatively, the control method comprises:

Step 2002: receiving a fourth instruction, and controlling the air-scattering assembly to move to open the air outlet according to the fourth instruction; and Step 2004: controlling the second air deflector of the air conditioner to rotate to the seventh angle, and controlling the first air deflector to rotate to the eighth angle.

Figure 29:
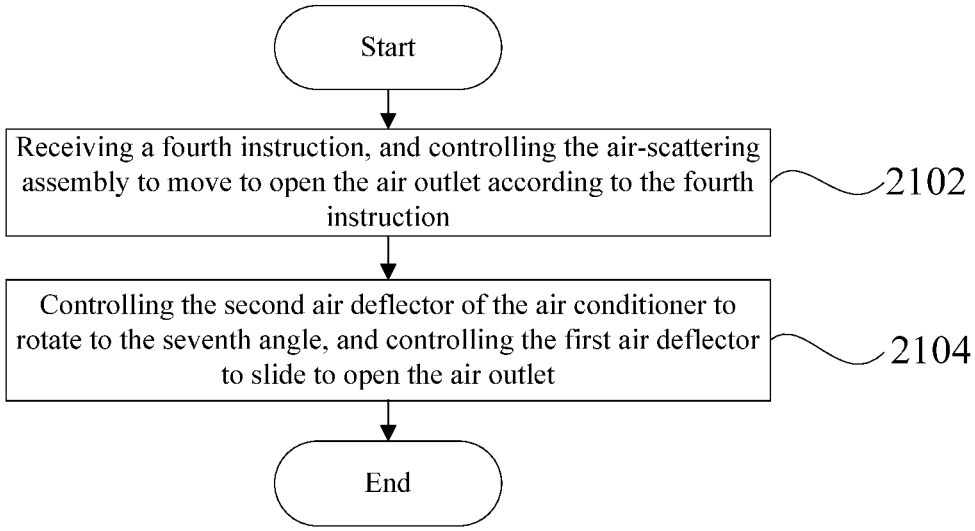
FIG. 29 is another schematic flow diagram of the control method.

As shown in FIG. 29, additionally or alternatively, the control method comprises:

Step 2102: receiving a fourth instruction, and controlling the air-scattering assembly to move to open the air outlet according to the fourth instruction; and Step 2104: controlling the second air deflector of the air conditioner to rotate to the seventh angle, and controlling the first air deflector to slide to open the air outlet.

A step following the step of receiving a fourth instruction and controlling the air-scattering assembly to move to open the air outlet according to the fourth instruction is further provided. The heating of the air conditioner can be achieved. For example, the air outlet is disposed in the front portion of the shell, the air-scattering assembly is used to close or open the air supply outlet and is also disposed at the front portion of the shell, the air outlet is formed between the first air deflector and the shell, and the first air deflector is disposed at the bottom of the shell; the air supplied by the air conditioner is distributed to the direction of the first air deflector through the rotation of the second air deflector to the seventh angle; the first air deflector rotates to the eighth angle or the first air deflector slides to open the air outlet, so that the air outlet is oriented toward the lower portion of the air conditioner, and this helps the air conditioner achieve supplying air by deviating to the lower side, and then this achieves pressing down hot air, and is especially suitable for the heating mode and can improve user experience.

Figure 30:
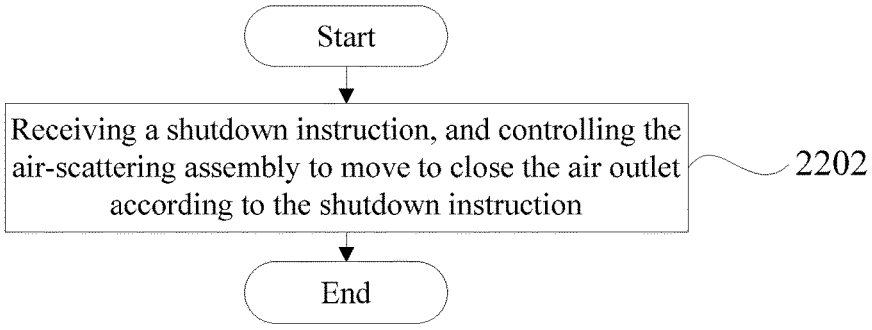
FIG. 30 is another schematic flow diagram of the control method.

As shown in FIG. 30, additionally or alternatively, the control method comprises:

Step 2202: receiving a shutdown instruction, and controlling the air-scattering assembly to move to close the air outlet according to the shutdown instruction.

The control instruction further comprises the shutdown instruction. When the shutdown instruction is received, the air-scattering assembly is controlled to move to close the air outlet according to the shutdown instruction, and then the air-scattering assembly, the first air deflector and the shell have an integrated appearance, and the grade of the product is improved.

An embodiment according to another aspect of the present disclosure provides a computer-readable storage medium. A computer program is stored in the computer-readable storage medium, and when the computer program is executed by a processor, the control method for the air conditioner according to any one of the above-mentioned embodiments is achieved.

The computer-readable storage medium provided by the present disclosure achieves the control method for the air conditioner in any one of the above embodiments as the computer program is executed by the processor, and thus has all the technical effects of the control method for the air conditioner in any one of the above embodiments, which are not repeated herein.

The air conditioner can comprise a shell 100, a chassis 500, an air-scattering assembly 300 and an air inlet grille 600; an air inlet is disposed in the back portion of the shell 100 of the air conditioner, the air inlet grille 600 is disposed at the air inlet, and an air inlet portion aims to keep sufficient air inlet area.

For the air conditioner of the embodiment, external air enters the shell 100, exchanges heat with the heat exchanger 700 and then is discharged through the air inlet.

Furthermore, an air outlet 104 is formed in the front portion of the surface frame 114 of the shell 100, and runs through the bottom of an air outlet frame; side openings 106 are formed in end caps of left and right sides of the surface frame 114; the front side of the surface frame 114 is provided with the air-scattering assembly 300 that can move up and down so as to open and close the air outlet 104. In a windless mode, the air-scattering assembly 300 closes the air outlet 104 and has the function of diffusing air.

Furthermore, the shell 100 further comprises a surface plate 116, and the surface plate 116 is disposed at the front portion of the surface frame 114 and located above the air outlet 104. The accommodating portion 110 which is suitable for accommodating at least a portion of the air-scattering assembly 300 is defined between the surface frame 114 and the surface plate 116.

Furthermore, the air conditioner comprises a first air deflector 200 that can rotate. In a shutdown state, the air-scattering assembly 300 forms a portion of the appearance of the product. In addition, a second air deflector 400 is formed inside the air outlet 104, a first air deflector 200 that can rotate is additionally disposed at the bottom side of the air outlet 104, and the first air deflector 200 can be a flat shape or an arc shape. In a windless air discharge mode, the first air deflector 200 can lean against the air-scattering assembly 300 to forma windless mode, and the second air deflector 400 can be disposed with one or more of through holes, air outlet grilles and air-scattering rotary vanes.

Additionally or alternatively, the first air deflector 200 that can slide is contained. In a shutdown state, the air-scattering assembly 300 forms a portion of the appearance of the product.

In addition, the second air deflector 400 is formed inside the air outlet 104, the first air deflector 200 that can extend or contract along an air outlet direction is additionally disposed at the bottom side of the air outlet 104. In the windless air discharge mode, the first air deflector 200 can lean against the air-scattering assembly 300 to form a windless mode, and the second air deflector 400 can be disposed with one or more of the through holes, the air outlet grilles and the air-scattering rotary vanes.

Additionally or alternatively, the air inlet of the air conditioner is disposed in the back portion and in the top portion, the air outlet 104 is disposed in the bottom portion, and windless components are formed integrally with the air conditioner in appearance.

Furthermore, when the air-scattering assembly 300 is in a working state, a cavity is formed among the air outlet 104, the air-scattering assembly 300, the shell 100 and the first air deflector 200. Air outlets are disposed in the side surface, the front surface and the bottom of the cavity to discharge air, and thus, in the windless mode, it is achieved that supplied air is weakened and air is discharged from different angles, thereby preventing cold air from blowing people, and the technical problems that the cooling capacity of the air conditioner is insufficient in a weak wind state or a windless state are solved. When the air-scattering assembly 300 does not work, the normal cooling or heating mode of the air conditioner is not affected.

Additionally or alternatively, in the heating mode of the air conditioner, the second air deflector 400 rotates to a heating position, and the first air deflector 200 also rotates to or slides to a position that is oriented toward the bottom side of the shell 100 and is conducive to heating; and in the cooling mode of the air conditioner, the second air deflector 400 rotates to a cooling position, the first air deflector 200 rotates towards the front side and is flush with the extending line of an air channel, which is conducive to cooling.

A control method for the air conditioner is further provided.

Figure 31:
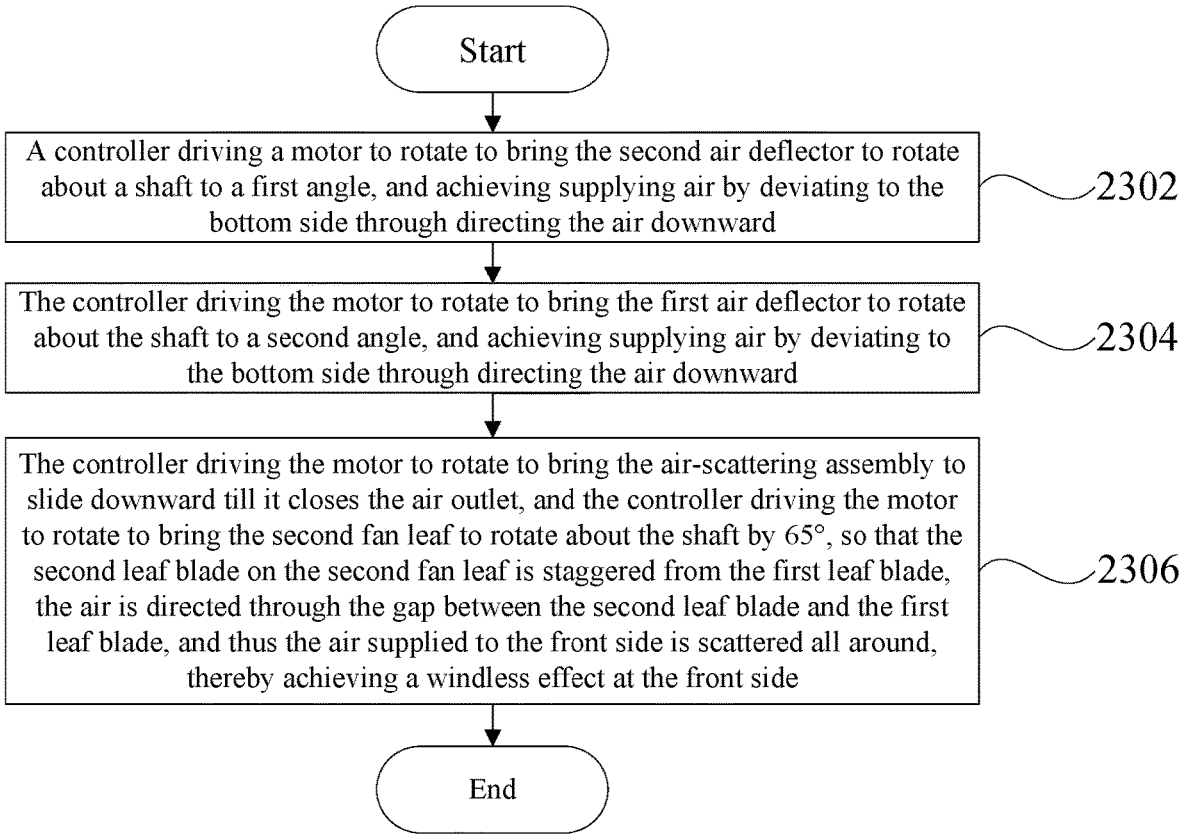
FIG. 31 is a schematic flow diagram of the control method, in which the air conditioner is controlled to work in the first operative configuration.

As shown in FIG. 31, a step of controlling the air conditioner to work in a first operative configuration according to the control method for the air conditioner comprises:

Step 2302: a controller driving a motor to rotate to bring the second air deflector to rotate about a shaft to a first angle, and achieving supplying air by deviating to the bottom side through directing the air downward;

Step 2304: the controller driving the motor to rotate to bring the first air deflector to rotate about the shaft to a second angle, and achieving supplying air by deviating to the bottom side through directing the air downward; and Step 2306: the controller driving the motor to rotate to bring the air-scattering assembly to slide downward till it closes the air outlet, and the controller driving the motor to rotate to bring the second fan leaf to rotate about the shaft by 65°, so that the second leaf blade on the second fan leaf is staggered from the first leaf blade, the air is directed through the gap between the second leaf blade and the first leaf blade, and thus the air supplied to the front side is scattered all around, thereby achieving a windless effect at the front side.

In the above solution, a windless feel at the front side of the air conditioner is achieved through controlling the cooperation action among the first air deflector, the second air deflector and the air-scattering assembly.

Figure 32:
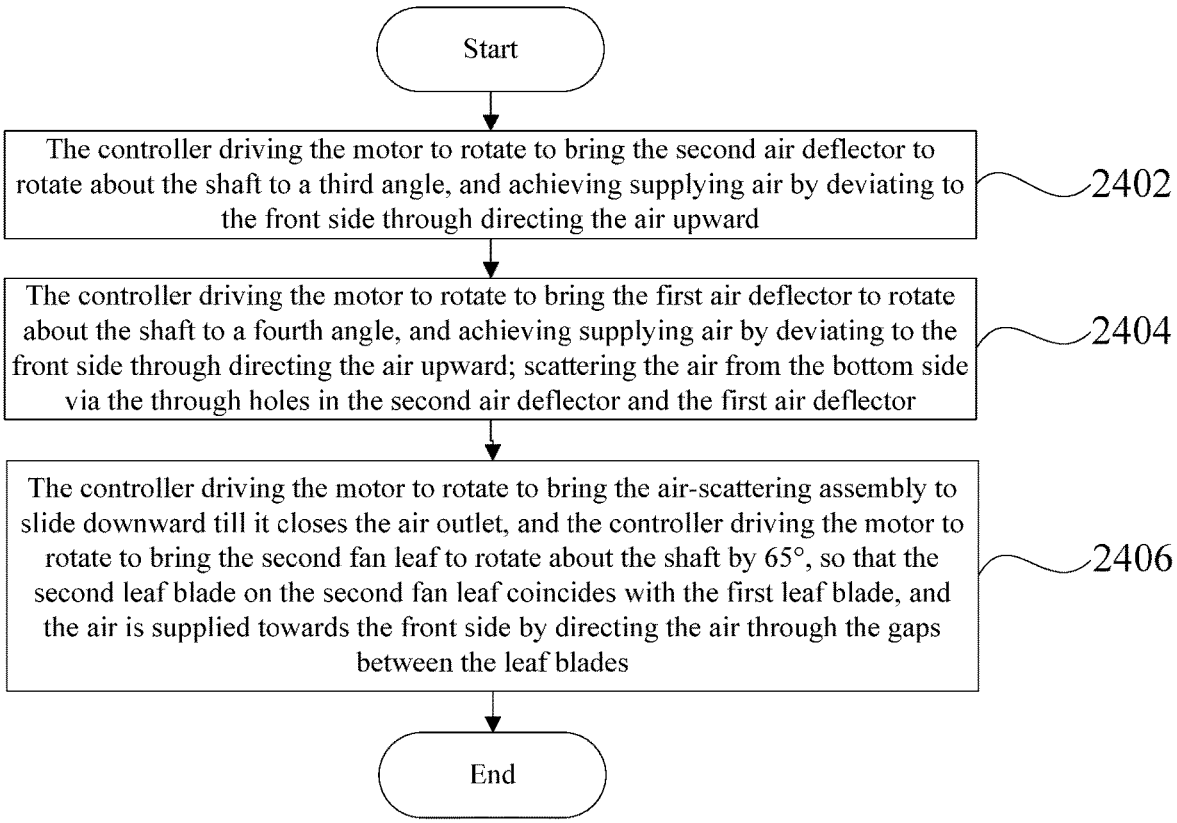
FIG. 32 is a schematic flow diagram of the control method, in which the air conditioner is controlled to work in the second operative configuration.

As shown in FIG. 32, the step of controlling the air conditioner to work in a second operative configuration according to the control method for the air conditioner comprises:

Step 2402: the controller driving the motor to rotate to bring the second air deflector to rotate about the shaft to a third angle, and achieving supplying air by deviating to the front side through directing the air upward;

Step 2404: the controller driving the motor to rotate to bring the first air deflector to rotate about the shaft to a fourth angle, and achieving supplying air by deviating to the front side through directing the air upward; scattering the air from the bottom side via the through holes in the second air deflector and the first air deflector; and Step 2406: the controller driving the motor to rotate to bring the air-scattering assembly to slide downward till it closes the air outlet, and the controller driving the motor to rotate to bring the second fan leaf to rotate about the shaft by 65°, so that the second leaf blade on the second fan leaf coincides with the first leaf blade, and the air is supplied towards the front side by directing the air through the gap between the leaf blades.

In the above solution, a windless feel at the bottom side of the air conditioner is achieved through controlling the cooperation action among the first air deflector, the second air deflector and the air-scattering assembly.

Figure 33:
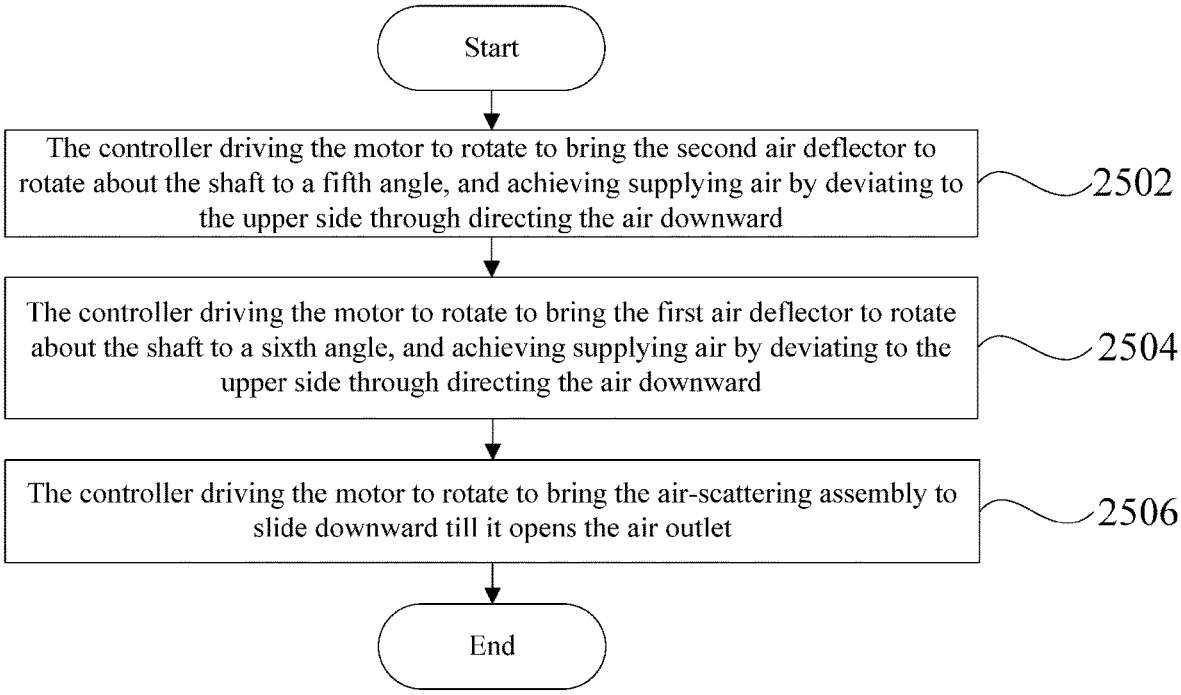
FIG. 33 is a schematic flow diagram of the control method, in which the air conditioner is controlled to work in the third operative configuration.

As shown in FIG. 33, the step of controlling the air conditioner to work in a third operative configuration according to the control method for the air conditioner comprises:

Step 2502: the controller driving the motor to rotate to bring the second air deflector to rotate about the shaft to a fifth angle, and achieving supplying air by deviating to the upper side through directing the air downward;

Step 2504: the controller driving the motor to rotate to bring the first air deflector to rotate about the shaft to a sixth angle, and achieving supplying air by deviating to the upper side through directing the air downward; and Step 2506: the controller driving the motor to rotate to bring the air-scattering assembly to slide downward till it opens the air outlet.

In the above solution, through controlling the cooperation action among the first air deflector, the second air deflector and the air-scattering assembly, it can be achieved that the air conditioner supplies air towards the upper side in a cooling/air supply mode, and thus it is achieved that the cool air sinks uniformly while does not blow directly.

Figure 34:
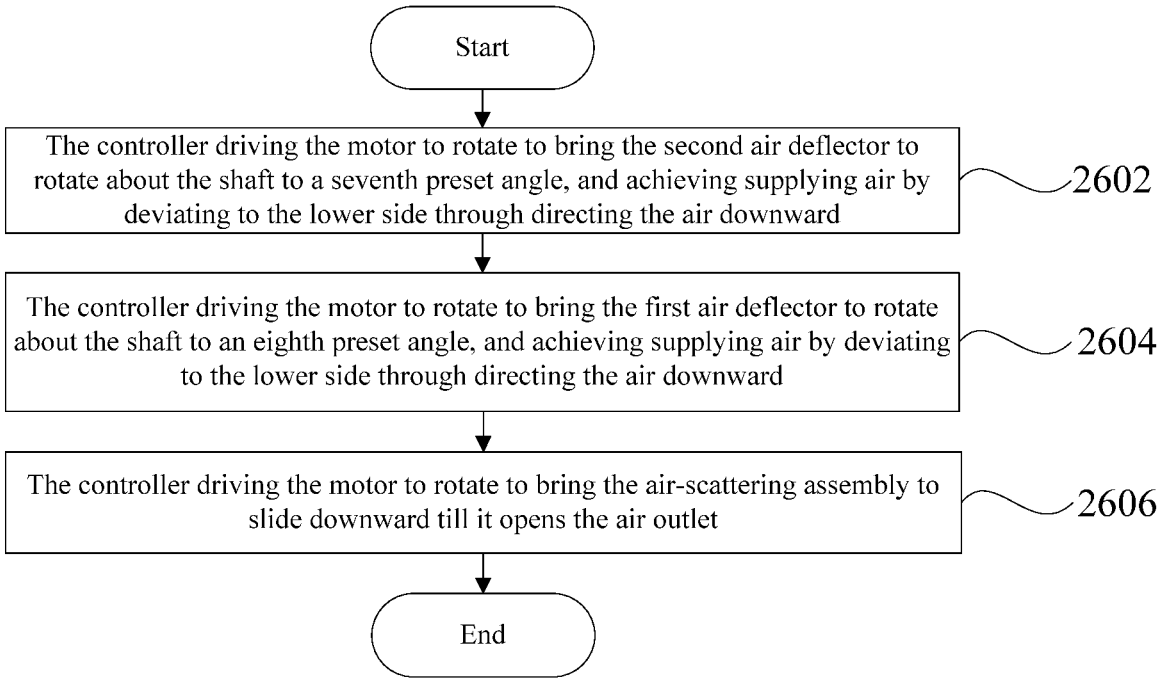
FIG. 34 is a schematic flow diagram of the control method, in which the air conditioner is controlled to work in the fourth operative configuration.

As shown in FIG. 34, the step of controlling the air conditioner to work in a fourth operative configuration according to the control method for the air conditioner comprises:

Step 2602: the controller driving the motor to rotate to bring the second air deflector to rotate about the shaft to a seventh preset angle, and achieving supplying air by deviating to the lower side through directing the air downward;

Step 2604: the controller driving the motor to rotate to bring the first air deflector to rotate about the shaft to an eighth preset angle, and achieving supplying air by deviating to the lower side through directing the air downward; and Step 2606: the controller driving the motor to rotate to bring the air-scattering assembly to slide downward till it opens the air outlet.

In the above solution, through controlling the cooperation action among the first air deflector, the second air deflector and the air-scattering assembly, it is achieved that the air conditioner supplies air towards the lower side in the heating mode and hot air is pressed down.

Figure 35:
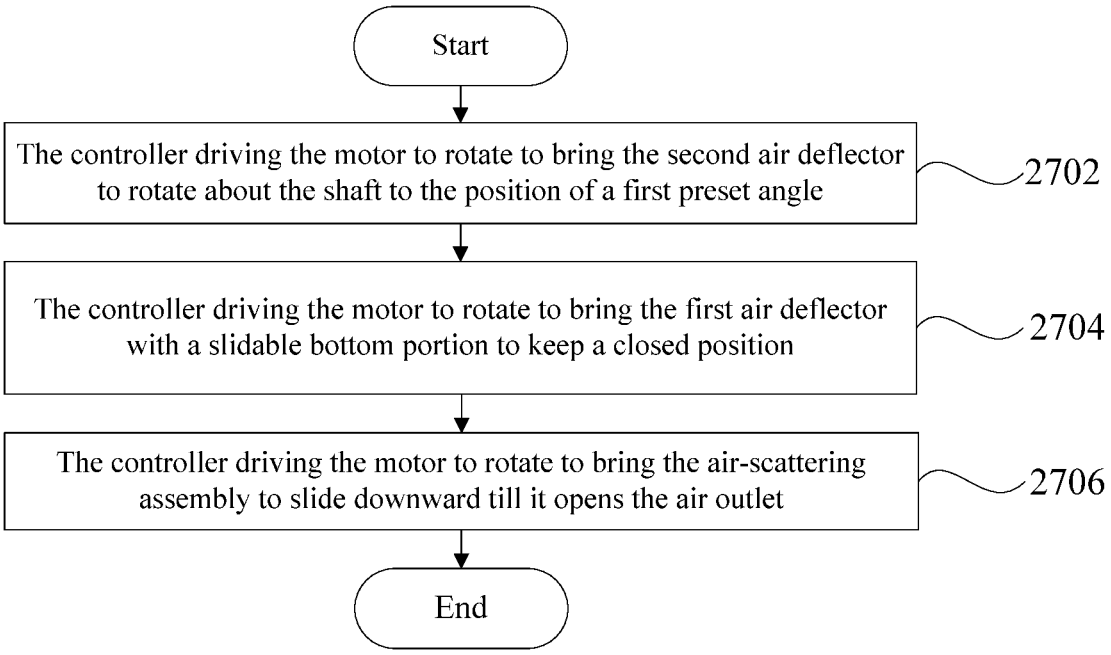
FIG. 35 is a schematic flow diagram of the control method, in which the air conditioner is controlled to work in a normal mode.

As shown in FIG. 35, the step of controlling the air conditioner in a normal mode according to the control method for the air conditioner comprises:

Step 2702: the controller driving the motor to rotate to bring the second air deflector to rotate about the shaft to the position of a first preset angle;

Step 2704: the controller driving the motor to rotate to bring the first air deflector with a slidable bottom portion to keep a closed position; and Step 2706: the controller driving the motor to rotate to bring the air-scattering assembly to slide downward till it opens the air outlet.

As shown in FIG. 12, through controlling the cooperation action among the first air deflector, the second air deflector and the air-scattering assembly, it is achieved that the air conditioner supplies the maximum capacity of cool air in normal conditions.

Figure 36:
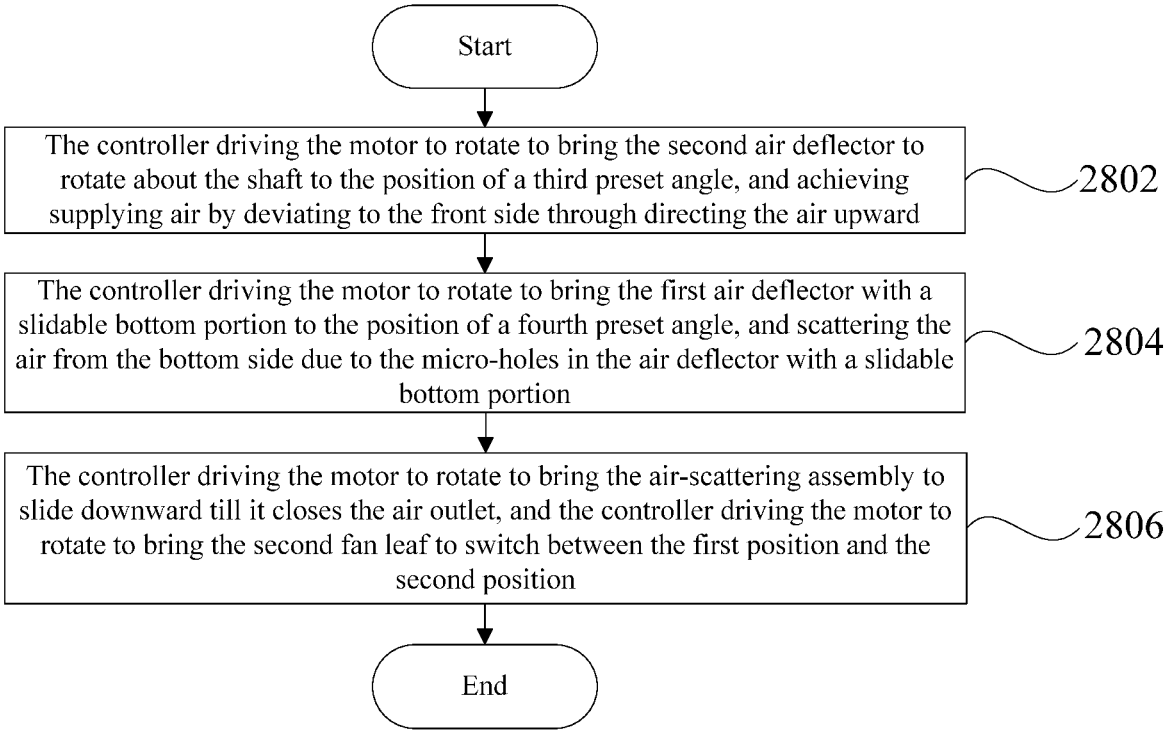
FIG. 36 is a schematic flow diagram of the control method, in which the air conditioner is controlled to work in a windless mode.

As shown in FIG. 36, the step of controlling the air conditioner in a windless mode according to the control method for the air conditioner comprises:

Step 2802: the controller driving the motor to rotate to bring the second air deflector to rotate about the shaft to the position of a third preset angle, and achieving supplying air by deviating to the front side through directing the air upward;

Step 2804: the controller driving the motor to rotate to bring the first air deflector with a slidable bottom portion to the position of a fourth preset angle, and scattering the air from the bottom side due to the micro-holes in the air deflector with a slidable bottom portion; and Step 2806: the controller driving the motor to rotate to bring the air-scattering assembly to slide downward till it closes the air outlet, and the controller driving the motor to rotate to bring the second fan leaf to switch between the first position and the second position.

The step of the switching of the second fan leaf between the first position and the second position comprises:

a, the controller driving the motor to rotate the second fan leaf and then bring the second leaf blade of the second fan leaf to rotate about the shaft by 65° and then stagger from the first leaf blade;

b, driving the motor to bring the second fan leaf to stay at the present position for 15 s;

c, the controller driving the motor to rotate to bring the second fan leaf to continue rotating about the shaft in the same direction by 65° and then coincide with the first leaf blade; and d, driving the motor to bring the second fan leaf to stay at the present position for 15 s.

As shown in FIG. 13, the windless feel of the air conditioner is achieved through controlling the cooperation action among the first air deflector, the second air deflector and the air-scattering assembly.

The control method for the air conditioner of the embodiment comprises the following beneficial effects:

Double-side windless feel: windless feel is achieved at the front side and the lower side; the distribution ratio of forward cooling capacity and downward cooling capacity is adjusted through the second air deflector inside the shell; through adjusting the opening action and the closing action of the air-scattering assembly in the front of the shell, the distribution ratio of forward cooling capacity and downward cooling capacity is adjusted to achieve a two-way cooling capacity adjustment, and a windless cool feel is controlled freely.

In the windless mode, the cooling capacity at the front side and the lower side can be adjusted; when supply of cooling capacity is focused on the front side or the bottom side, the corresponding air volume is not less than 50% of the total air volume.

In the description of the present disclosure, the term of "multiple" refers to two or more, unless otherwise clearly defined. The terms "mounting", "connected to", "connected with", "fix" and the like should be understood in a broad sense, for example, the term "connected to" can be a fixed connection, a detachable connection, or an integral connection; the term "connected with" can be a direct connection or an indirect connection through an intermediate medium. For those skilled in the art, they may understand the specific meanings of the above-mentioned terms in the present disclosure according to specific circumstances.

In the description of the present disclosure, the terms of "an embodiment", "some embodiments", "specific embodiment" and the like mean that the specific features, structures, materials or characteristics described in combination with the embodiment or example are included in at least one embodiment or example of the present disclosure. In the description, the illustrative expression of the above terms may not indicate the same embodiment or example. In addition, the specific features, structures, materials or characteristics described above may be combined in an appropriate method in one or more of any embodiments or examples.

The above-mentioned are merely some preferred embodiments of the present disclosure and are not intended to limit the present disclosure, and for one skilled in the art, various modifications and changes may be made to the present disclosure. Any modifications, equivalent substitutions, improvements and so on made within the spirit and principle of the present disclosure should be covered within the scope of protection of the present disclosure.

What is claimed is:

1. An air conditioner comprising:

a shell provided with an opening portion;

a first air deflector connected to the shell, wherein an air outlet is defined by the first air deflector and the opening portion; and an air-scattering assembly comprising an air-scattering component, wherein the air-scattering component is configured to allow an airflow to pass through the air-scattering component, and is further configured to diffuse the airflow passing through the air-scattering component, wherein the air-scattering assembly is movable relative to the shell for selectively opening or closing the air outlet, wherein the air-scattering component comprises:

a first fan leaf including a first leaf blade, and a second fan leaf including a second leaf blade, and wherein:

the second fan leaf and the first fan leaf are arranged along an axial direction and the second fan leaf is adapted to rotate to a first position and a second position, when the second fan leaf is located at the first position, the second leaf blade and the first leaf blade are staggered from each other along the axial direction of the air-scattering component, and when the second fan leaf is located at the second position, the second leaf blade and the first leaf blade at least partially coincide with each other along the axial direction of the air-scattering component.

2. The air conditioner according to claim 1, wherein:

the opening portion is formed with a notch, and the first air deflector is configured to cover a portion of the notch and define the air outlet together with the notch.

3. The air conditioner according to claim 1, wherein:

the first air deflector is disposed rotatably, and the first air deflector is configured to be suitable for rotating to change an air discharge direction of the air outlet.

4. The air conditioner according to claim 1, wherein:

the first air deflector is disposed slidably, and the first air deflector is configured to slide into the shell and slide out of the shell.

5. The air conditioner according to claim 1, wherein:

the first air deflector is configured to lean against and cooperate with the air-scattering assembly for fitting together and defining a cavity, and the cavity is communicated with the air outlet.

6. The air conditioner according to claim 5, wherein:

side openings are respectively formed in both ends of the shell along a length direction of a splicing line of the first air deflector and the air-scattering assembly, and the side openings are communicated with the cavity.

7. The air conditioner according to claim 1, wherein the first air deflector is provided with an air discharge component.

8. The air conditioner according to claim 7, wherein:

the air discharge component comprises through holes, or the air discharge component comprises air outlet grilles, or the air discharge component comprises air-scattering rotary vanes, and the air-scattering rotary vanes are configured to allow the airflow to pass through the air-scattering rotary vanes and diffuse the airflow passing through the air-scattering rotary vanes.

9. The air conditioner according to claim 1, wherein:

the first air deflector has an air guide surface, and the air guide surface comprises an arc surface or a flat surface.

10. The air conditioner according to claim 1, further comprising a second air deflector, wherein the second air deflector is provided at the air outlet, and wherein the second air deflector is configured to rotate to adjust air volume flowing out of the air outlet to the first air deflector and the air-scattering assembly.

11. The air conditioner according to claim 10, wherein:

the air conditioner has a first operative configuration, and when the air conditioner is in the first operative configuration, the air-scattering assembly closes the air outlet, the second air deflector rotates to a first angle, the second fan leaf is located at the first position, the first air deflector rotates to a second angle or the first air deflector slides to lean against and cooperate with the air-scattering assembly, and/or the air conditioner has a second operative configuration, and when the air conditioner is in the second operative configuration, the air-scattering assembly moves to close the air outlet, the second air deflector rotates to a third angle, the second fan leaf is located at the second position, the first air deflector rotates to a fourth angle or the first air deflector slides to lean against and cooperate with the air-scattering assembly, and/or the air conditioner has a third operative configuration, and when the air conditioner is in the third operative configuration, the air-scattering assembly moves to open the air outlet, the second air deflector rotates to a fifth angle, the first air deflector rotates to a sixth angle, or the first air deflector slides to open the air outlet, and/or the air conditioner has a fourth operative configuration, and when the air conditioner is in the fourth operative configuration, the air-scattering assembly moves to open the air outlet, the second air deflector rotates to a seventh angle, the first air deflector rotates to an eighth angle, or the first air deflector slides to open the air outlet, and/or the air conditioner has a fifth operative configuration, and when the air conditioner is in the fifth operative configuration, the air-scattering assembly moves to close the air outlet.

12. The air conditioner according to claim 1, wherein:

the shell comprises an accommodating portion, and at least a portion of the air-scattering assembly is accommodated in the accommodating portion.

13. The air conditioner according to claim 12, wherein:

the accommodating portion comprises an accommodating groove, and the air-scattering assembly is slidably connected with the accommodating groove, and the air-scattering assembly slides relative to the accommodating groove to extend out of the accommodating groove or to be accommodated in the accommodating groove.

14. The air conditioner according to claim 13, wherein:

the shell further comprises a surface frame and a surface plate, the opening portion is formed in the surface frame, and the accommodating portion is defined by the surface plate and the surface frame, and the accommodating portion is disposed in a front portion of the shell.

15. A method for controlling the air conditioner according to claim 1, comprising:

receiving a control instruction, and controlling the air-scattering assembly to move to open or close the air outlet according to the control instruction.

16. The method according to claim 15, wherein:

the control instruction comprises a first instruction, and the receiving the control instruction and the controlling the air-scattering assembly to move to open or close the air outlet according to the control instruction comprises:

receiving the first instruction, and controlling the air-scattering assembly to close the air outlet according to the first instruction.

17. The method according to claim 16, wherein after the receiving the first instruction and the controlling the air-scattering assembly to close the air outlet according to the first instruction, the method further comprises:

controlling a second air deflector of the air conditioner to rotate to a first angle, controlling the first air deflector to rotate to a second angle, and controlling a second fan leaf of the air conditioner to be at a first position, or controlling the second air deflector of the air conditioner to rotate to the first angle, controlling the first air deflector to slide to lean against and cooperate with the air-scattering assembly, and controlling the second fan leaf to be at the first position.

18. The method according to claim 17, wherein:

the control instruction comprises a second instruction, and the receiving the control instruction and the controlling the air-scattering assembly to move to open or close the air outlet according to the control instruction comprises:

receiving a second instruction, and controlling the air-scattering assembly to move to close the air outlet according to the second instruction.

19. The method according to claim 18, wherein after the receiving the second instruction and the controlling the air-scattering assembly to move to close the air outlet according to the second instruction, the method further comprises:

controlling the second air deflector of the air conditioner to rotate to a third angle, controlling the first air deflector to rotate to a fourth angle, and controlling the second fan leaf of the air conditioner to be at a second position, or controlling the second air deflector of the air conditioner to rotate to the third angle, controlling the first air deflector to slide to lean against and cooperate with the air-scattering assembly, and controlling the second fan leaf to be at the second position.

20. The method according to claim 19, further comprising:

controlling the second fan leaf to switch between the first position and the second position, wherein the second fan leaf is maintained at the first position for a first period of time and the second fan leaf is maintained at the second position for a second period of time.

21. The method according to claim 15, wherein:

the control instruction comprises a third instruction, and the receiving the control instruction and the controlling the air-scattering assembly to move to open or close the air outlet according to the control instruction specifically comprises:

receiving the third instruction, and controlling the air-scattering assembly to move to open the air outlet according to the third instruction.

22. The method according to claim 21, wherein after the receiving the third instruction and the controlling the air-scattering assembly to move to open the air outlet according to the third instruction, the method further comprises:

controlling a second air deflector of the air conditioner to rotate to a fifth angle, and controlling the first air deflector to rotate to a sixth angle, or controlling the second air deflector of the air conditioner to rotate to the fifth angle, and controlling the first air deflector to slide to open the air outlet.

23. The method according to claim 15, wherein:

the control instruction comprises a fourth instruction, and the receiving the control instruction and the controlling the air-scattering assembly to move to open or close the air outlet according to the control instruction comprises:

receiving the fourth instruction, and controlling the air-scattering assembly to move to open the air outlet according to the fourth instruction.

24. The method according to claim 23, wherein after the receiving the fourth instruction and the controlling the air-scattering assembly to move to open the air outlet according to the fourth instruction, the method further comprises:

controlling a second air deflector of the air conditioner to rotate to a seventh angle, and controlling the first air deflector to rotate to an eighth angle, or controlling the second air deflector of the air conditioner to rotate to the seventh angle, and controlling the first air deflector to slide to open the air outlet.

25. The method according to claim 15, wherein:

the control instruction comprises a shutdown instruction, and the receiving the control instruction and the controlling the air-scattering assembly to move to open or close the air outlet according to the control instruction comprises:

receiving the shutdown instruction, and controlling the air-scattering assembly to move to close the air outlet according to the shutdown instruction.

26. A non-transitory computer-readable storage medium storing a computer program, wherein when executed by a computer, the computer program causes the computer to implement the method according to claim 15.

* * * * *